US011242215B2

(12) United States Patent
Bumgarner et al.

(10) Patent No.: US 11,242,215 B2
(45) Date of Patent: Feb. 8, 2022

(54) APPARATUS AND METHODS FOR DETECTING STRAY OPTICAL FIBERS DURING WINDING

(71) Applicant: CORNING INCORPORATED, Corning, NY (US)

(72) Inventors: Kirk Patton Bumgarner, Hampstead, NC (US); James Robert Lechleider, Wilmington, NC (US); Dustin Michael Skinner, Wilmington, NC (US); William Joseph Stokes, Wilmington, NC (US)

(73) Assignee: Corning Incorporated, Corning, NY (US)

( * ) Notice: Subject to any disclaimer, the term of this patent is extended or adjusted under 35 U.S.C. 154(b) by 167 days.

(21) Appl. No.: 16/799,256

(22) Filed: Feb. 24, 2020

(65) Prior Publication Data

US 2020/0283258 A1 Sep. 10, 2020

Related U.S. Application Data

(60) Provisional application No. 62/814,918, filed on Mar. 7, 2019.

(51) Int. Cl.

| | |
|---|---|
| ***B65H 63/032*** | (2006.01) |
| ***B65H 54/72*** | (2006.01) |
| ***B65H 63/00*** | (2006.01) |

(52) U.S. Cl.

CPC ..... *B65H 63/0324* (2013.01); *B65H 54/72* (2013.01); *B65H 63/006* (2013.01); *B65H 2701/32* (2013.01)

(58) Field of Classification Search

CPC .. B65H 63/006; B65H 63/0324; B65H 54/72; B65H 2701/32

See application file for complete search history.

(56) References Cited

U.S. PATENT DOCUMENTS

| | | | |
|---|---|---|---|
| 2,413,486 | A | 12/1946 | Denyssen |
| 3,345,812 | A | 10/1967 | Pickering |

(Continued)

FOREIGN PATENT DOCUMENTS

| | | | |
|---|---|---|---|
| CN | 1938580 | A | 3/2007 |
| CN | 102692216 | A | 9/2012 |

(Continued)

OTHER PUBLICATIONS

International Search Report and Written Opinion of the International Searching Authority; PCT/US2020/018490; dated May 29, 2020; 14 Pages; European Patent Office.

*Primary Examiner* — William E Dondero

(74) *Attorney, Agent, or Firm* — Kevin L. Bray

(57) ABSTRACT

The apparatus and methods disclosed herein are directed to detecting the presence of a whipping tail when using a fiber winding system to wind a fiber onto a rotating spool. The fiber is guided onto the rotating spool through a containment region between the spool and a whip shield to create the wound fiber. The whipping tail outwardly extends from the wound fiber and periodically or quasi-periodically passes through a light beam to create a series intensity dips in the light beam, thereby forming a modulated light beam. The modulated light beam is converted into a digital electrical signal made up of electrical pulses having a timing defined by the intensity dips. The measured timing of the electrical pulses is compared to an estimated timing based on the rotating spool to ascertain the presence of a whipping tail.

26 Claims, 12 Drawing Sheets

(56) References Cited

U.S. PATENT DOCUMENTS

| | | | |
|---|---|---|---|
| 3,461,299 | A | 8/1969 | Felix |
| 3,514,615 | A | 5/1970 | Noiles et al. |
| 3,633,835 | A | 1/1972 | Beers |
| 3,712,743 | A | 1/1973 | Harris et al. |
| 4,948,260 | A | 8/1990 | Felix et al. |
| 5,172,421 | A | 12/1992 | Nakamura et al. |
| 5,964,431 | A | 10/1999 | Chang et al. |
| 6,027,062 | A | 2/2000 | Bacon et al. |
| 6,400,137 | B1 | 6/2002 | Muzslay et al. |
| 7,372,553 | B2 | 5/2008 | Aoshima et al. |
| 10,526,162 | B2 | 1/2020 | Montaigne et al. |

FOREIGN PATENT DOCUMENTS

| | | | |
|---|---|---|---|
| CN | 204964409 | U | 1/2016 |
| CN | 105819277 | B | 8/2018 |
| EP | 0873962 | A1 | 10/1998 |
| FR | 2570092 | A1 | 3/1986 |
| WO | 0132574 | A1 | 5/2001 |
| WO | 2016/128784 | A1 | 8/2016 |

APPARATUS AND METHODS FOR DETECTING STRAY OPTICAL FIBERS DURING WINDING

CROSS-REFERENCE TO RELATED APPLICATIONS

This Application claims priority under 35 USC § 119(e) from U.S. Provisional Patent Application Ser. No. 62/814,918, filed on Mar. 7, 2019, and which is incorporated by reference herein in its entirety.

FIELD

The present disclosure is generally directed to a fiber winding apparatus and methods for winding fiber onto a rotating spool, and in particular relates to apparatus and methods for detecting a whipping tail during the fiber winding process.

BACKGROUND

In the fiber manufacturing industries, long lengths of optical fiber ("fiber") are wound at high speeds upon machine-rotated take-up spools for shipping and handling. As the fiber is wound on the spool, the fiber is laid down onto the spool in successive layers. In the fiber industry, fiber winding typically occurs at the draw tower where the fiber is originally drawn, and at an off-line screening station where the fiber is strength tested. At each of these locations, the fiber can be wound at high speeds, for example, over 20 meters per second and higher, and is maintained at relatively high tension. The fiber winding machine may include a feed assembly that includes several pulleys arranged to guide the fiber. The pulleys also facilitate maintaining proper tension on the fiber as it is wound onto the spool, while the feed apparatus facilitates uniform fiber winding onto the spool.

During winding, the fiber is susceptible to breakage due to forces applied by the winding machine. When a fiber break occurs during winding, it creates a loose end or "fiber tail." The rapid rotation of the take-up spool causes the fiber tail to whip around at high speed, thereby forming what is referred to herein as a "whipping tail." An uncontrolled whipping tail can impact fiber already wound onto the spool and cause significant damage to many layers of the fiber, as well as to the tail itself. The break event may be intentional or unpredictable. Either way, following a fiber break the rotation of the spool must be brought to an immediate stop to prevent the whipping tail from damaging the fiber.

SUMMARY

An embodiment of the disclosure is a method of detecting a whipping tail when winding a fiber onto a rotating spool having a winding surface and a rotational speed, comprising: a) winding the fiber onto the winding surface of the rotating spool to form a wound fiber thereon, wherein the whipping tail outwardly extends from the wound fiber; b) directing a light beam so that the whipping tail at least partially intersects the light beam either periodically or quasi-periodically due to the rotating spool to create intensity dips in the light beam to form a modulated light beam; c) converting the modulated light beam into a digital electrical signal made up of electrical pulses having a timing defined by the intensity dips; and d) comparing the timing of the electrical pulses to an estimated timing based on the rotational speed of the rotating spool to detect the whipping tail.

Another embodiment of the disclosure is a method of detecting a whipping tail in a fiber winding system, comprising: a) winding a fiber onto a winding surface of a rotating spool having a rotation axis and opposing outer flanges by passing the fiber through a containment region formed between the rotating spool and a containment shield operably disposed relative to and spaced apart from the winding surface, thereby forming on the winding surface a wound fiber having a wound fiber surface, and wherein the whipping tail extend outwardly from the wound fiber surface; b) directing a light beam proximate the rotating spool and through the containment region such that the whipping tail substantially periodically passes through at least a portion of the light beam to form intensity dips in the light beam to form from the light beam a modulated light beam; c) converting the modulated light beam into a digital signal comprising electrical pulses having an electrical pulse timing as defined by the intensity dips; and d) comparing the electrical pulse timing to an estimated timing of the whipping tail based on at least one operational parameter of the fiber winding system.

Another embodiment of the disclosure is a fiber winding system for winding a fiber and that can detect a whipping tail, comprising: a) a spool configured to rotate about a rotation axis, the spool having a winding surface on which the fiber is wound to form a wound fiber, wherein the whipping tail extends outwardly from the wound fiber; b) a feed mechanism configured to feed the fiber onto the spool surface at a line speed; c) a whip shield operably disposed relative to the spool to form a containment region between the spool and the whip shield; and d) a whipping tail detection apparatus comprising: i) a light source configured to emit a light beam over an optical path that is substantially parallel to the rotation axis, that traverses the containment region so that the whipping tail if present substantially periodically passes through at least a portion of the light beam due to the rotation of the spool to form a series of intensity dips in the light beam to form therefrom a modulated light beam; ii) a light detector configured to detect the modulated light beam and form therefrom an analog electrical signal having a series of signal dips defined by the series of intensity dips; and iii) a controller configured to receive and process the analog electrical signal to establish the presence of the whipping tail by comparing a timing of the signal dips to an estimated whipping tail timing.

DETAILED DESCRIPTION

Figure 1A:
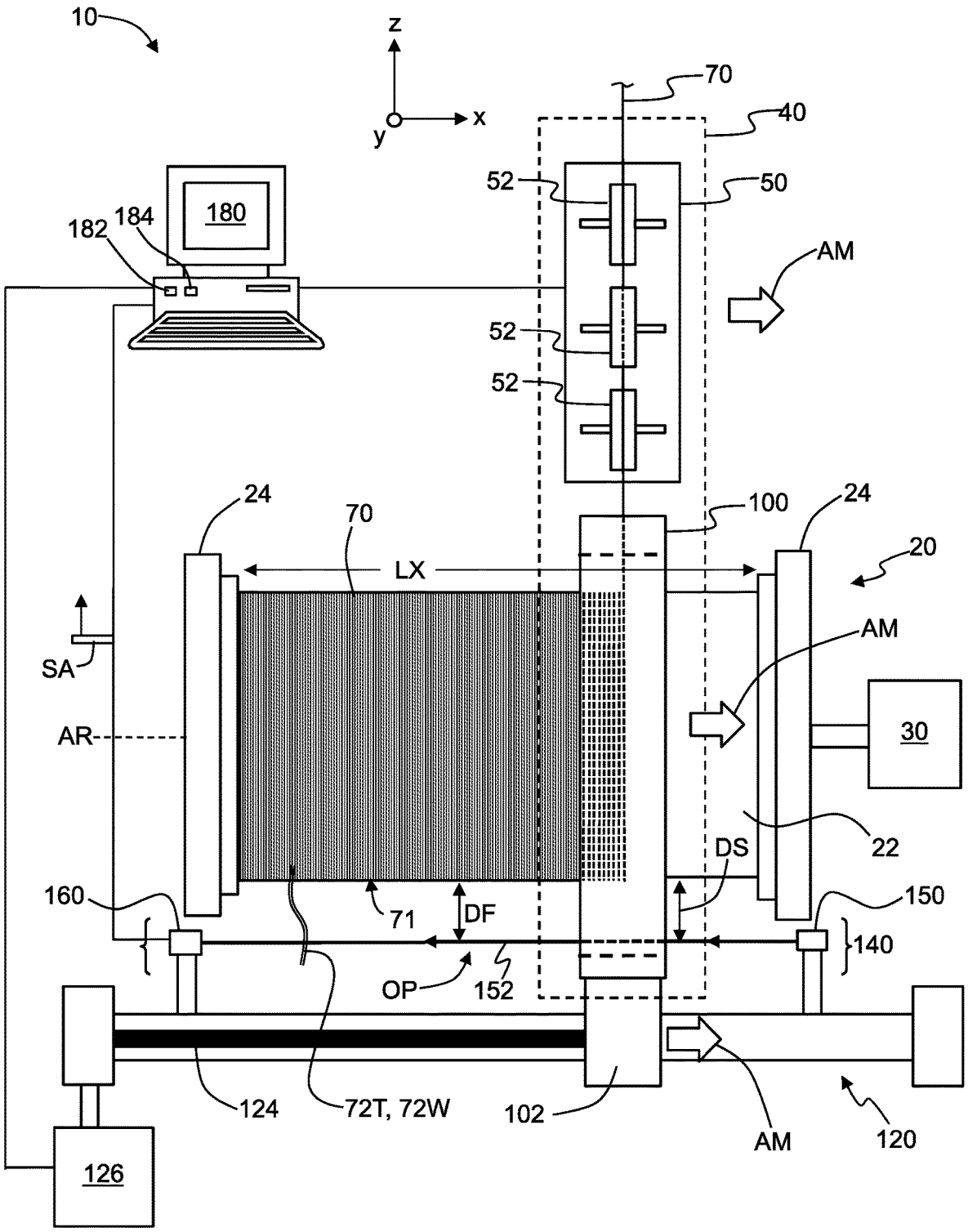
FIG. 1A is a schematic diagram of an example fiber winding system according to the disclosure.

Reference is now made in detail to example embodiments as illustrated in the accompanying drawings. Whenever possible, the same reference numbers will be used throughout the drawings to refer to the same or like parts.

Cartesian coordinates are shown in some of the Figures for the sake of reference and to facilitate the discussion and are not intended to be limiting as to direction or orientation.

The term "comprises" as used herein (e.g., "A comprises B") includes "consists of" as a special case (e.g., "A consists of B").

The terms "upstream" ("downstream") as used herein with respect to A and B means that A comes before (after) B with respect to the operational flow (e.g., with respect to the direction of travel of light or the direction of travel of electrical signals).

In the discussion below, fiber is referred to as just "fiber," and includes both glass fiber and plastic fiber.

The acronym "RPM" stands for "revolutions per minute" while the acronym "RPS" stands for "revolutions per second," which in the discussion below is also measured in units of Hertz (Hz).

A fiber tail is an end piece or end section or terminal end of a fiber. The fiber tail can be the terminal or bitter end of a spooled fiber or it can be an end section of fiber that is not part of the spooled fiber, e.g., a separate or "stray" piece of fiber from another spool or from another length of fiber previously wound on the spool, or from any other source of fiber. The fiber tail extends from the surface of the wound fiber (or from the spool) and whips around as the spool spins. This whipping action is referred to herein generally as fiber whip, though some in the art refer to fiber whip in the narrower sense as a whipping action that causes damage. A fiber tail that moves by virtue of relatively fast rotation of the spool is referred to herein as a "whipping tail." The presence of a whipping tail implies the existence of a fiber tail, and so in the discussion below reference is made in some instances to just the whipping tail for ease of discussion.

Thus, in one instance, a fiber tail can occur as part of a normal or planned winding process, such as when the fiber being wound onto the spool is intentionally cut to terminate the fiber winding on the spool. This type of fiber tail is referred to herein as a "natural fiber tail," which forms a "natural whipping tail." As explained in the discussion below, a natural whipping tail can be used as part of a calibration process ensure that the fiber winding system is operating properly. In another instance, the fiber tail can be due to an unintentional break of the fiber or due to the presence of a stray fiber, which gives rise to what is referred to herein as a "stray fiber tail," which causes a "stray whipping tail" during spool rotation. The occurrence of both natural and stray whipping tails need to be detected because the fiber whip caused by either type of whipping tail can damage the spooled fiber and pose a safety hazard.

Use of the term "fiber tail" below includes both natural and stray fiber tails unless otherwise noted. Likewise, use of the term "whipping tail" includes both natural and stray whipping tails unless otherwise noted. And as noted above, the term "fiber whip" refers to the potentially damaging whipping action of a whipping tail.

A whip shield is any structure used in a fiber winding system to contain a whipping tail to within a containment region defined at least in part by the whip shield.

The term "periodically" or "quasi-periodically" is used herein to describe the frequency at which a whipping tail crosses (passes through, traverses, etc.) the light beam. While the spool is assumed to rotate at a constant rate, the motion of the whipping tail caused by the rotating spool can be erratic and thus not perfectly periodic. Consequently, the resulting modulation of the light beam may not be ideally periodic. The phrase "substantially periodic" can mean either periodic or quasi-periodic. In general, there is one pass of the whipping tail through the light beam for each rotation of the spool, though there can be exceptions, e.g., if the whipping tail motion becomes erratic.

The term "amplifier" as used herein is a type of signal conditioner used to receive and perform one or more signal processing acts on an electrical signal The amplifier can be programmable and include a variety of internal components configured to process and condition the signal, e.g., a filter, an analog-to-digital converter, a central processing unit (CPU), a signal amplifier, etc. An example amplifier of the kind discussed herein is available from Banner Engineering Corp., Minneapolis, Minn.

Fiber Winding System

FIG. 1A is a schematic diagram of an example fiber winding system ("system") 10 according to the disclosure. The system 10 includes a spool 20 having a winding surface 22 with a length LX in the x-direction. In an example, the winding surface 22 is cylindrical. The spool 20 also includes opposing outer flanges 24. The spool 20 is mechanically connected to a drive motor 30, which drives the spool so that it rotates about a rotation axis AR, which is shown aligned with the x-direction.

Figure 2A:
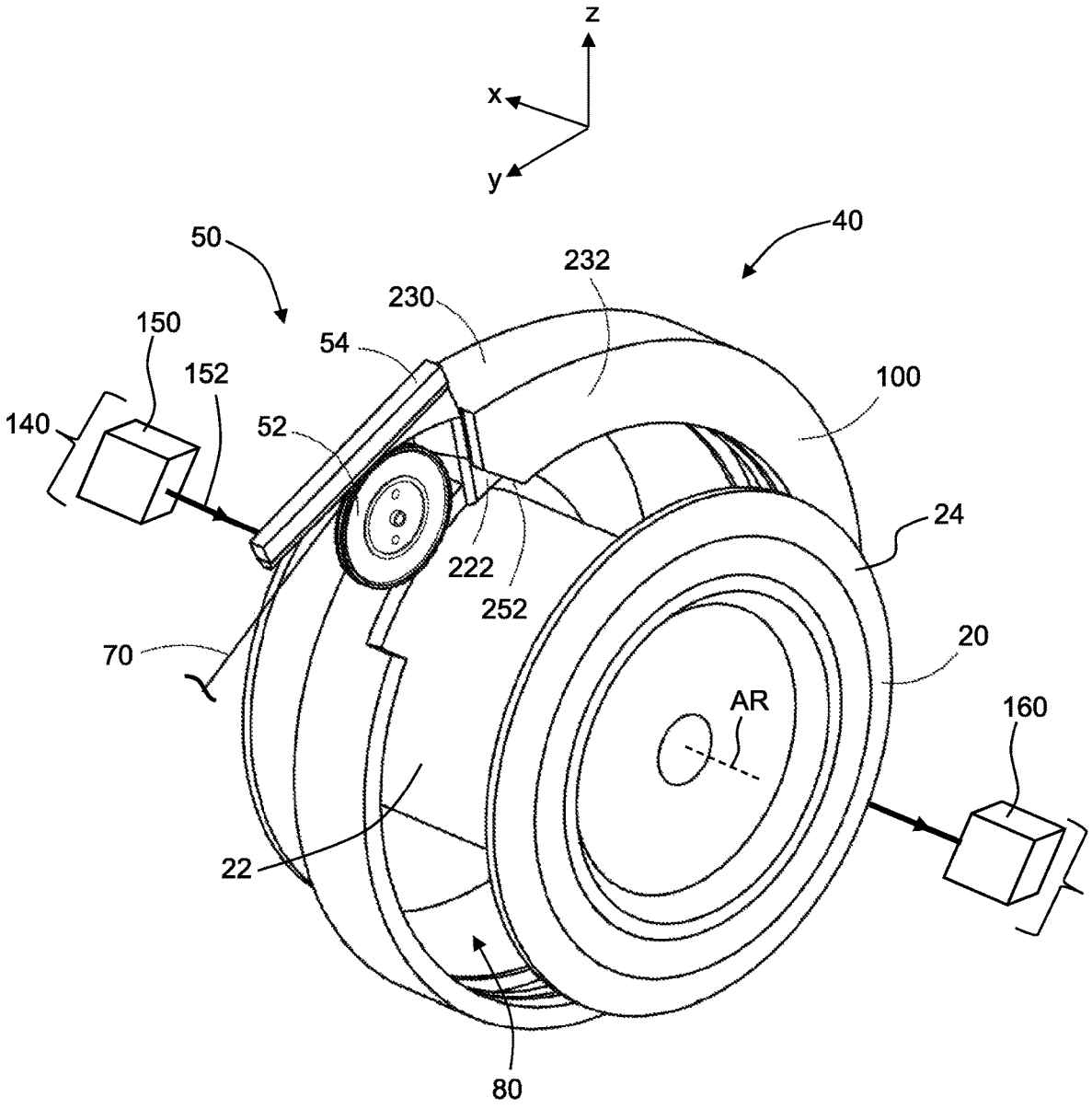
FIG. 2A is a close-up elevated view of the fiber winding device of the fiber winding system of FIG. 1A, wherein the fiber winding device includes a feed mechanism for feeding the fiber, a fiber spool, and an example whip shield in the form of a whip ring operably disposed relative to the fiber spool to form the containment region.
Figure 2B:
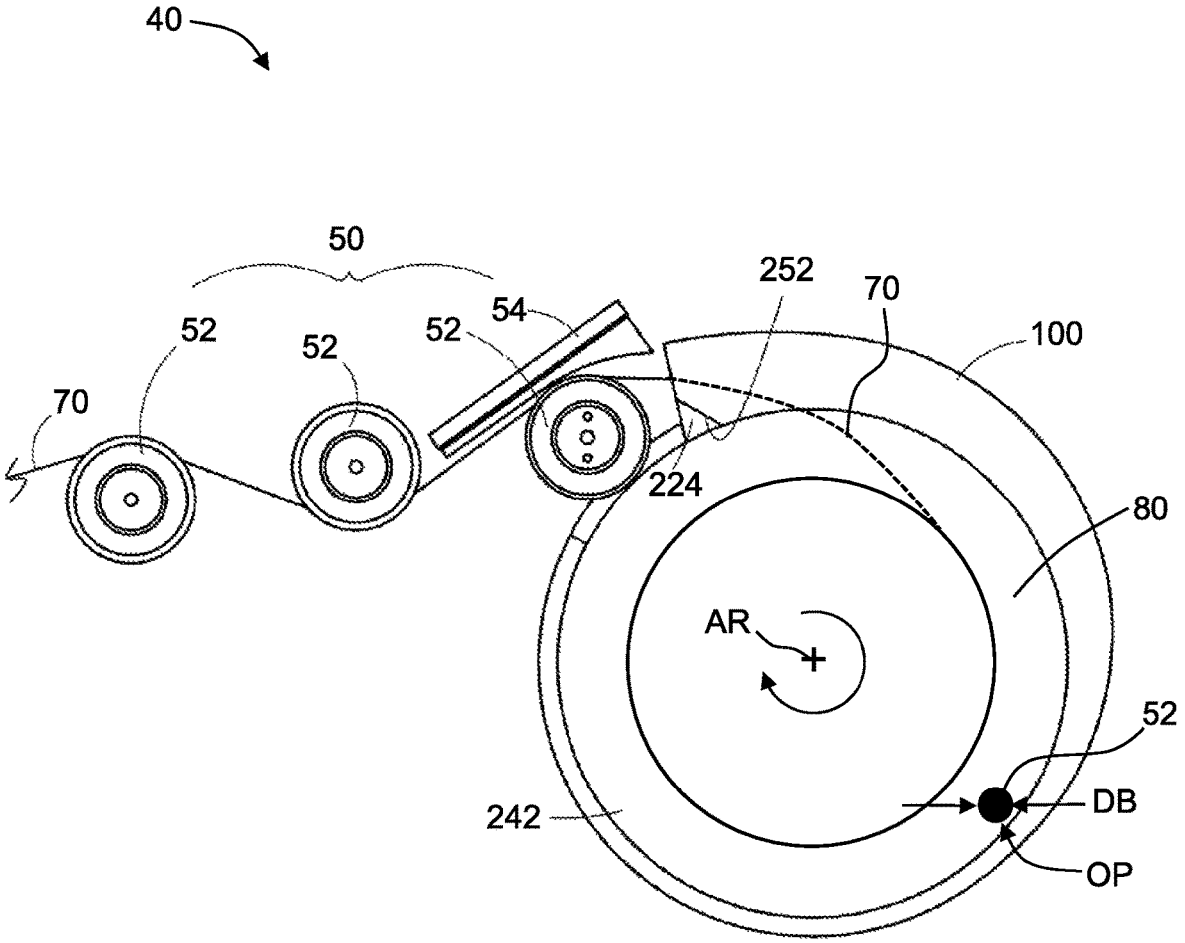
FIG. 2B is a side view of the fiber winding device of FIG. 2A and illustrates the light beam from the whipping tail detection apparatus passing through the containment region defined by the whip shield and the spool, and also illustrating an example operating condition where there is no whipping tail.

A fiber winding device 40 is operably disposed relative to the spool 20. FIG. 2A is a close-up elevated view of an example of the fiber winding device 40, while FIG. 2B is a close-up side view of the example fiber winding device. The fiber winding device 40 includes a feed mechanism 50 for feeding an optical fiber ("fiber") 70 onto the spool 20. In an example, the feed mechanism 50 is configured to measure (i.e., keep track of) an amount (length) of the fiber 70 wound on the spool 20 during the winding process. This winding information can be provided to the controller 180, which is introduced and discussed below.

The fiber winding device 40 also includes a whip shield 100 operably arranged relative to the spool 20. In an example, the whip shield 100 surrounds a portion of the spool 20, e.g., a portion of the circumference or the entire circumference but at least a portion of the axial length. The example whip shield 100 of FIG. 1A can include a mounting bracket 102.

In an example, the whip shield 100 can extend substantially the entire length LX of the spool 20, or can extend along a portion of the length of the spool. In an example where the whip shield 100 extends over a relatively small portion of the length LX of the spool 20, the whip shield can also be referred to as a "whip ring." The example whip shield in FIG. 2A is in the form of a whip ring that covers the entire circumference of the spool 20 but only a relatively narrow portion of the axial length of the spool. As noted above, the systems and methods disclosed herein are not limited to any particular type of whip shield, and the whip shield 100 shown in FIG. 2A is considered herein as one illustrative example.

Figure 1B:
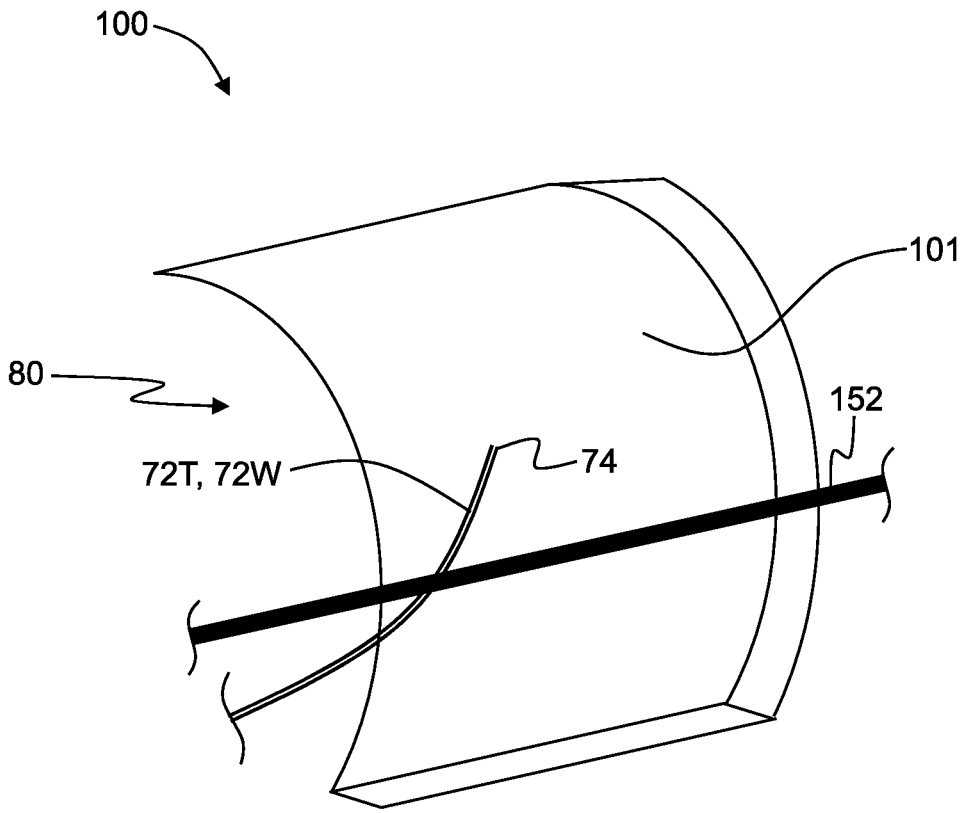
FIG. 1B is a close up view of a portion of an example simple whip shield that can be used in the fiber winding system of FIG. 1A to form a containment region to control fiber whipping.

FIG. 1B is a close up view of a portion of an example of the whip shield 100 that has a simple configuration, e.g., as defined a curved and rigid structure with a smooth inner surface 101 that faces the spool 20. FIG. 1B shows a fiber tail 72T of the fiber 70. The fiber tail 72T has an end 74. Rotation of the spool 20 makes the fiber tail 72T also a whipping tail 72W. In FIG. 1B, the whipping tail 72W is shown as being constrained by the whip shield 100, which can include the end 74 of the fiber tail 72T contacting the inner surface 101 of the whip shield while the spool 20 spins. Thus, in the example, the whipping tail 72W is contained within a containment region 80 formed by the space between the spool 20 and the inner surface 101 of the whip shield 100. In other examples below (e.g., when the fiber tail 72T is a stray fiber tail), the whipping tail 72W may not be so confined, i.e., may not reside within the containment region 80.

With reference again to FIG. 1A, the system 10 also includes a guide rail 120 arranged proximate the spool 20 and that runs substantially parallel to the rotation axis AR of the spool 20. The guide rail 120 slidably supports the mounting bracket 102 of the whip shield 100 so that the whip shield can move in the x-direction (or −x direction). The guide rail 120 can include a drive member 124 operably connected to a whip shield drive motor 126 configured to drive the movement of the annular whip shield 100 along the guide rail. In an example, the drive member 124 comprises a push rod. FIG. 1A includes movement arrows AM that show the movement of the whip shield 100 along the guide rail and the corresponding (e.g., tandem or synchronous) motion of the fiber winding device 40, as explained below.

The system 10 also includes a whipping tail detection apparatus ("detection apparatus") 140. The detection apparatus 140 includes a light source (light transmitter) 150 and a light detector (light receiver) 160. The light source 150 emits a light beam 152 having a wavelength λ. An example range for the light-beam wavelength λ is the visible wavelength range. Another example wavelength is ultraviolet, such as the near-ultraviolet, e.g., 350 nm.

The light beam 152 travels over an optical path OP between the light source 150 and the light detector 160. The optical path OP passes through at least a portion of the containment region 80 between the spool 20 and whip shield 100 (see, e.g., FIG. 1B and FIG. 2A). The light beam 152 has a beam diameter DB (see FIG. 2B). In an example, the beam diameter DB can be substantially constant and in the range from 1 mm (e.g., a laser beam) to 10 mm. The actual beam diameter DB used depends on the amount of room available for the beam to traverse the containment region 80 in the x-direction. In other examples, the diameter DB of the light beam 152 changes along the optical path OP because the light beam expands it travels from the light source 150. An embodiment of such a case is illustrated in the example whipping tail detection apparatus 140 of FIG. 1E, introduced and discussed below.

In an example, the optical path OP is substantially parallel to the rotation axis AR and resides just beyond the spool outer flanges 24. In an example, the optical path OP has a length substantially the same as or greater than the length LX of the spool winding surface 22 in the x-direction. FIG. 2A illustrates an example configuration wherein the light source 150 and the light detector 160 reside outside of (beyond) the respective outer flanges 24 of the spool 20, i.e., the optical path OP has a length greater than the axial length LX of the spool winding surface 22. This configuration can help to reduce adverse effects of reflection from the fiber 70 wound on the spool 20.

The optical path OP resides a distance DS from the spool winding surface 22 and a distance DF from a surface 71 of the fiber 70 as wound on the spool winding surface (see FIG. 1A). This surface is referred to herein as the wound fiber surface 71. In an example, the distances DS and DF are whatever distances are necessary and/or reasonable to accommodate the wound fiber 70 on the winding surface 22 of the spool 20 without interfering with the winding operation while also minimizing damage to the fiber tail 72T, especially when the fiber tail is a natural fiber tail. The fiber tail 72T extends from the wound fiber surface 71 (see FIG. 1A).

Figure 1C:
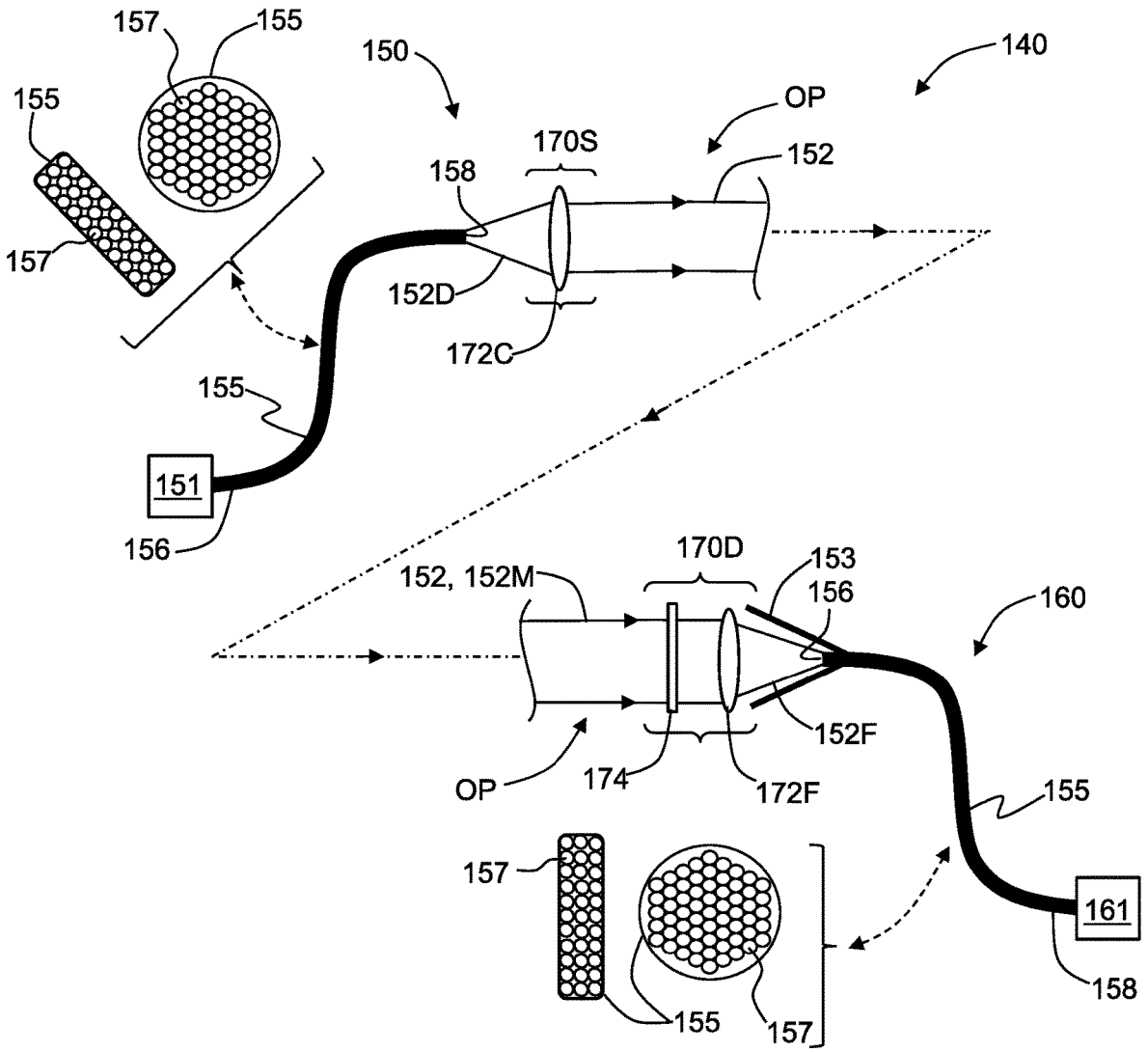
FIG. 1C is a schematic diagram of a portion of an example whipping tail detection apparatus as disclosed herein that can be integrated with the fiber winding system and that in the example shown employs fiber bundles optically coupled via respective optical systems.

FIG. 1C is a close-up view of a portion of an example configuration of the detection apparatus 140. In an example, the light source 150 comprises a light emitter 151, such as a laser diode or a light-emitting diode (LED). The light emitter 151 is optically coupled to a fiber bundle 155 at an input end 156 of the fiber bundle. The fiber bundle 155 also has an output end 158 opposite the input end 156. The fiber bundle 155 comprises an array of individual fibers 157. The light detector 160 also includes a fiber bundle 155, with the output end 158 optically coupled to an optical sensor 161, such as a photodiode, digital image sensor, etc. The close-up insets show two example cross-sectional configurations of the fiber bundle 155, namely elongate and substantially round (e.g. polygonal).

The fiber bundle 155 of the light source 150 emits diverging light 152D from its output end 158. A light-source optical system 170S is used to convert the diverging light 152D into a substantially collimated light beam 152. In an example, the light-source optical system 170S includes a collimating lens 172C, which can comprise one or more lens elements.

The collimated light beam 152 can be focused down onto the input end 156 of the fiber bundle 155 of the detector system 160 using a light-detector optical system 170D configured to convert the collimated light beam 152 to a converging or focused light beam 152F. The light-detector optical system 170D can also include a narrow-band wavelength filter 174 configured to transmit a narrow range of wavelengths around the light-beam wavelength λ. The narrow-band wavelength filter 174 helps to eliminate stray light from other source of light that can give rise to false signals, e.g., create false signal pulses, as described below. The use of a substantially collimated light beam 152 also serves to minimize reflections of the light beam 152 from components of system 10, wherein such reflections can also give rise to false signals.

In an example, the fiber bundle 155 used in the light detector 160 is smaller than that used in the light source 150 or has a different cross-sectional shape. Such a configuration can reduce the amount of stray light that enters the fiber bundle 155 at the light detector 160. In an example, a light shade 153 (e.g., in the form of a cone or nozzle) can be used at the input end 156 of the fiber bundle 155 at the light detector 160 to further reduce adverse effects of stray light.

Figure 1D:
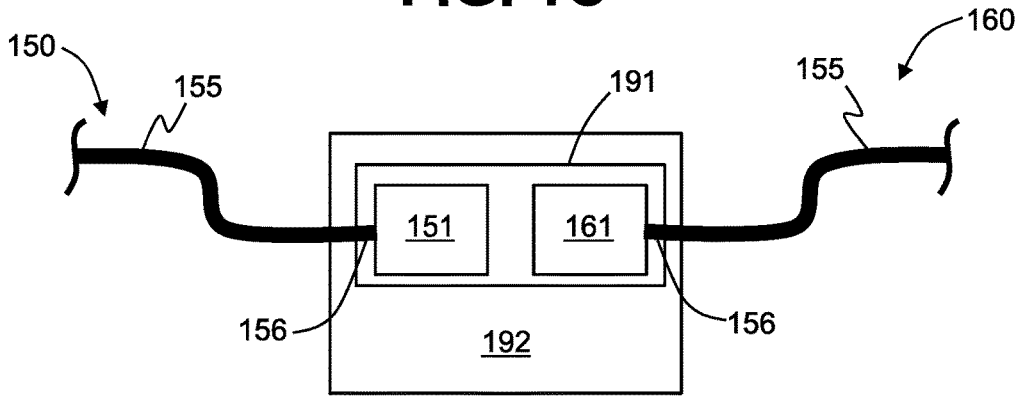
FIG. 1D is a close-up schematic diagram of an example configuration of the whipping tail detection apparatus wherein the light source and optical sensor constitute a transceiver incorporated into an amplifier.

FIG. 1D is a close-up view of an example configuration where the light emitter 151 and the optical sensor 161 comprise a transducer 191 that is part of an amplifier 192. This configuration has the advantage that the amplifier 192 can be programmed to control the operation of the light emitter 151 based on the output of the optical sensor, as discussed in greater detail below. This control can include automatic setting of detection thresholds, timing for transmitting detector signals, etc.

With reference again to FIG. 1A, the system 10 also includes a controller 180 operably connected to one or more of the spool drive motor 30, the fiber winding device 40, whip shield drive motor 126 and the detection apparatus 140. The controller 180 is configured to control the operation of system 10 using, for example, instructions embodied in a non-transitory computer-readable medium. In an example, the instructions are in the form of firmware or software known in the art or programmed in a manner known in the art (e.g., using one of the know computer languages for machine control and data processing). In an example, the controller 180 comprises a general-purpose computer or a micro-controller or programmable logic controller (PLC). Also in an example, the controller 180 includes a memory 182 and processor 184 and other components configured to receive data signals and perform data signal processing and analysis as described in greater detail below. The detection apparatus 140 includes the controller 180, which as noted above is operably connected to the light detector 160 and also can be connected to the light source 150.

Figure 1E:
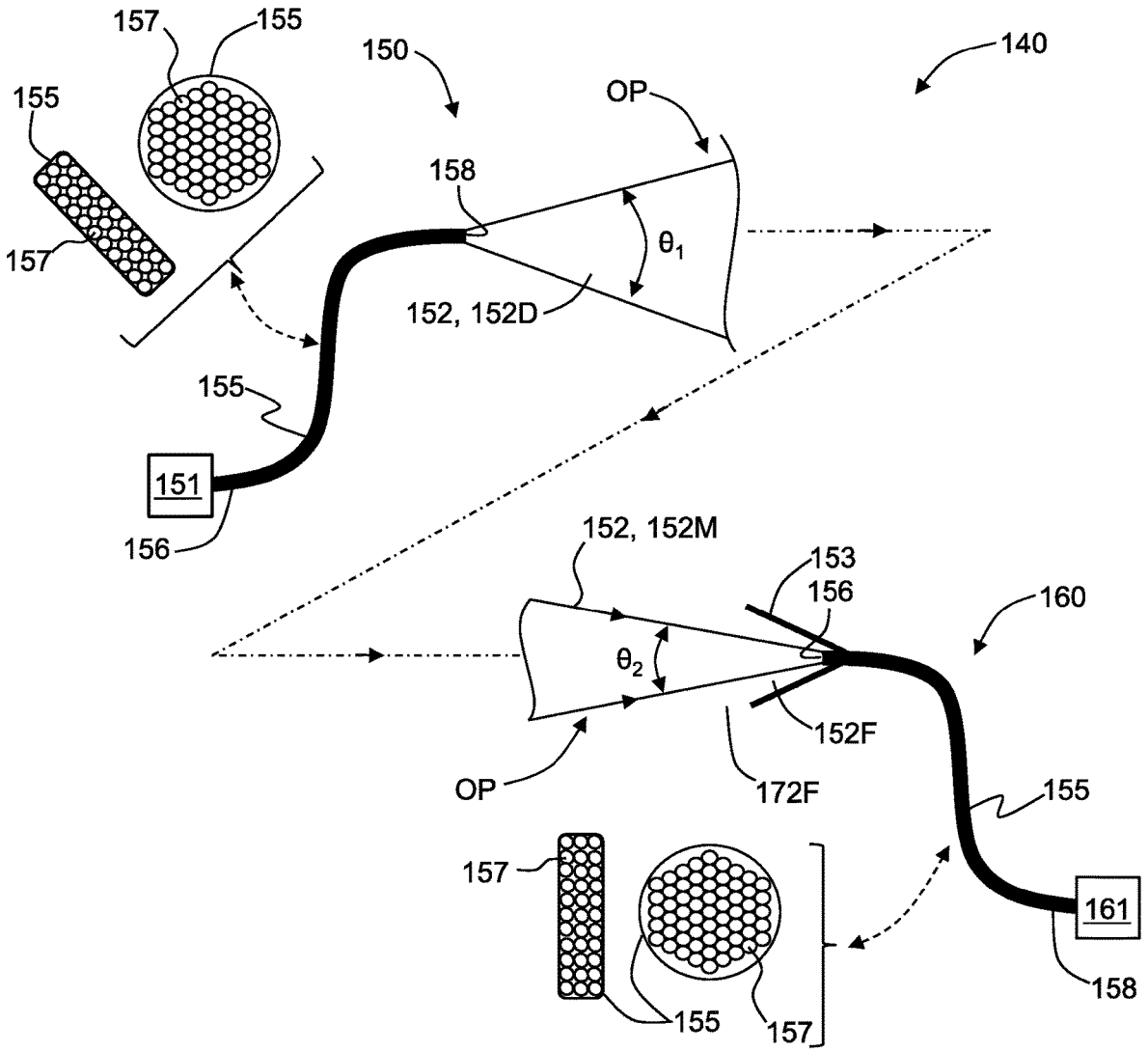
FIG. 1E is similar to FIG. 1C and illustrates an embodiment of a simplified configuration of the whipping tail detection apparatus that utilizes fiber bundles, but that does not employ optical systems.

FIG. 1E is similar to FIG. 1C and shows an example of the detection apparatus 140 that does not employ light-source and light-detector optical systems 170S and 170D. In this embodiment, the diverging light beam 152D spreads out at an emission angle $\theta_1$ from the fiber bundle 155 of the light source 150. The portion of the light beam 152 that falls within the receiving angle $\theta_2$ of the fiber bundle 155 of the light detector 160 is detected by the optical sensor 161.

The configuration of the detection apparatus 140 in FIG. 1E is simpler than that of FIG. 1C and may be easier and more cost-effective to implement in certain configurations of the system 10. On the other hand, allowing the light beam 152 to diverge can give rise to scattered and reflected light, which can enter the fiber bundle 155 at the light detector 160, thereby making the subsequent signal processing more complex. For example, it was found that the amount of reflected light from the light beam 152 reaching the light detector 160 from the spool 20 can vary based on the color of the fiber 70 and the amount of fiber wound on the spool 20. In an example, the amplifier configuration of FIG. 1D can be used to mitigate light detection issues from light reflection by configuring the amplifier 192 to adjust the light emission and detection properties, such as by adjusting the gain, setting automatic light detection thresholds, etc., based on anticipated or measured light detection issues. In another example, the signal processing using the controller 180 can be performed in a manner that accounts for adverse effects of light reflection as obtained by empirical study or by computer simulations.

Another embodiment of the detection apparatus 140 similar to that of FIG. 1E utilizes a laser-based light emitter 151 that emits a highly collimated and relatively narrow (i.e., small diameter) laser beam 152. Such an embodiment can obviate the need for the fiber bundles 155 and light-source optical system 170S and a light-detector optical system 170D.

Other embodiments of the detection apparatus 140 can employ at least one of the light-source optical system 170S and the light-detector optical system 170D.

With reference again to FIG. 1A and FIG. 2B, the example feed mechanism 50 of the fiber winding device 40 includes three pulleys 52 that guide the fiber 70 under tension so that it can be feed onto the spool 20. The feed mechanism 50 can also optionally include a fiber guide 54 (not shown in FIG. 1A) that also serves as a whip reducer if the fiber 70 breaks, as described below. Thus, the fiber guide 54 can also be referred to as a fiber-whip-reducing fixture.

In the operation of system 10, the spool 20 is rotated by the spool drive motor 30, which applies tension to the fiber 70. The fiber 70 is fed onto the winding surface 22 of the spool 20 using the feed mechanism 50. The fiber 70 winds onto the spool 20 with multiple overlapping layers of fiber, with the initial layer residing directly upon the winding surface 22. The fiber 70 may be wound onto the spool 20 at a relatively high rate of speed, e.g., line speeds of about 30, 40, 50, 60, 70 m/s or potentially even higher. The fiber 70 is also maintained at a sufficiently high tension to ensure proper winding onto the spool 20. In an example, the fiber 70 may be supplied directly from any known type fiber drawing apparatus (not shown) or a known type of fiber tensile or other screening device (not shown) or other fiber source (e.g., another fiber spool).

Figure 2C:
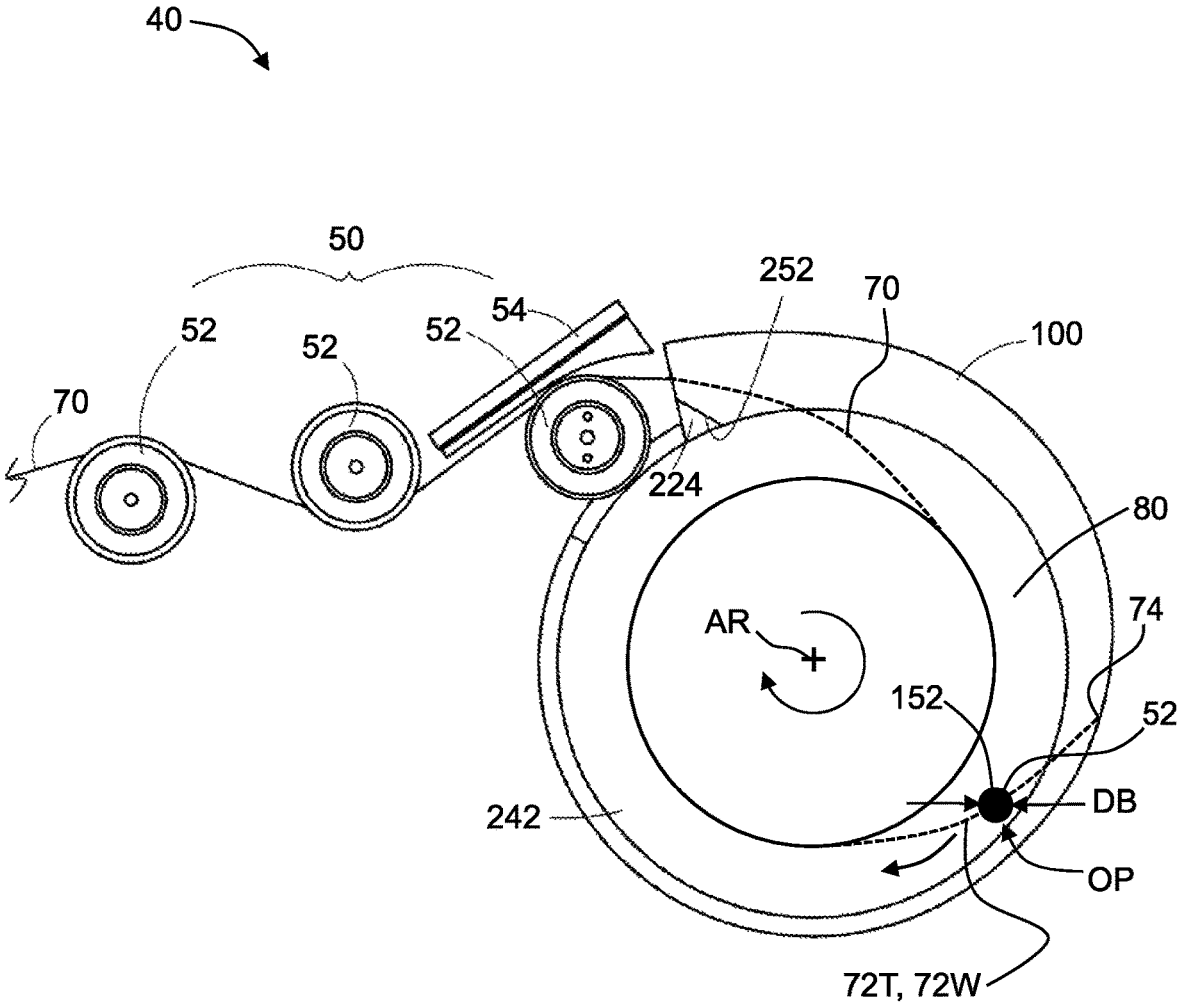
FIG. 2C is similar to FIG. 2B and illustrates an operating condition where there is a whipping tail that intersects the light beam as the whipping tail traverses the containment region due to the rotation of the spool.

FIG. 2C is similar to FIG. 2B, but shows an example operational condition of the system 10 where there exists a fiber tail 72T that spins around with the spool, thereby giving rise to a whipping tail 72W. Note that the example fiber tail end 74 of FIG. 2C is shown as contacting the whip shield 100, which is also the case discussed above in FIG. 1B. When the fiber tail 72T is a natural fiber tail, the fiber tail is typically contained within a ring-type whip shield 100 because the such a whip shield moves to follow the location of the fiber 70 being wound so that the fiber is fed onto the spool 20 through the containment region 80. As alluded to above, this may not be the case for a stray fiber tail 72T, which can arise anywhere along the spool during winding and not just at the location where the fiber 70 is being wound. In such a case, the ring-type whip shield 100 may end up passing over the stray whipping tail 72W during spool rotation and fail to prevent whip damage because the whipping tail does remain within the relatively narrow containment region 80 of a ring-type whip shield 100. Nevertheless, the stray whipping tail can be detected by the detection apparatus 140 since the light beam 152 passes close to and along the length of the spool 20 (see FIG. 1A). In the case of a full-length whip shield, a stray whipping tail 72W will typically reside within the containment region 80.

Ideally, if the spool 20 were suspended in free space, there would be no need for any whip shield or guard around the spool 20 since the whipping tail 72W would not hit anything. However, this is not the case given that the system 10 has other components nearby. Consequently, to contain the whipping tail 72T to prevent damage to the fiber already wound on spool 20, as well as to prevent injuries to operators standing near the spool 20, the whip shield 100 is employed.

Example Whip Shield

Figure 3A:
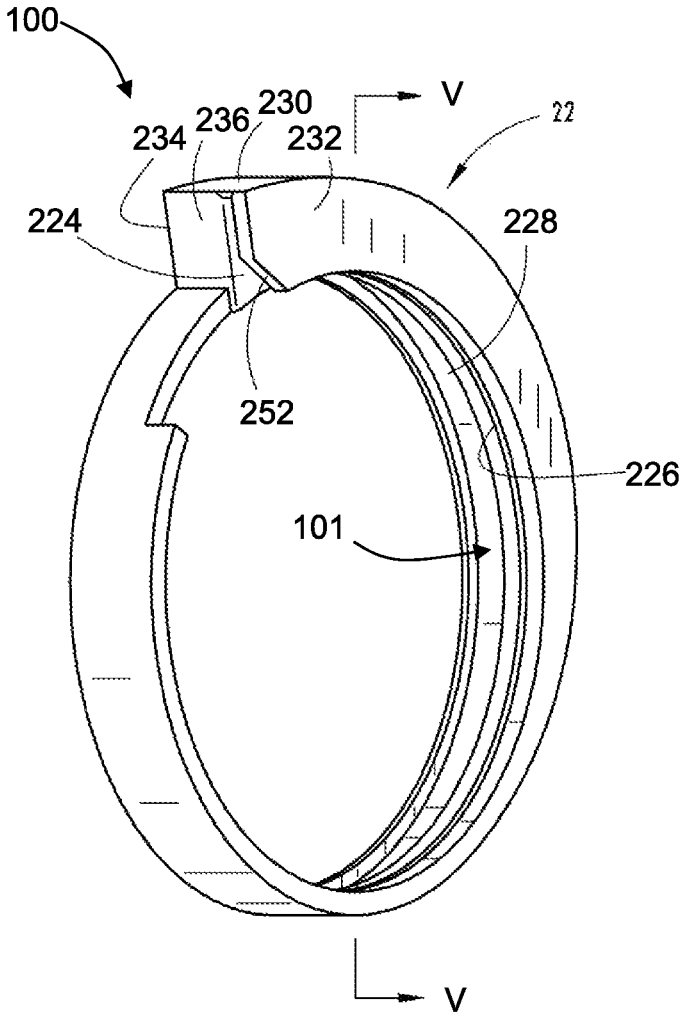
FIGS. 3A and 3B are elevated and side views of an example whip shield in the form of a whip ring.
Figure 3B:
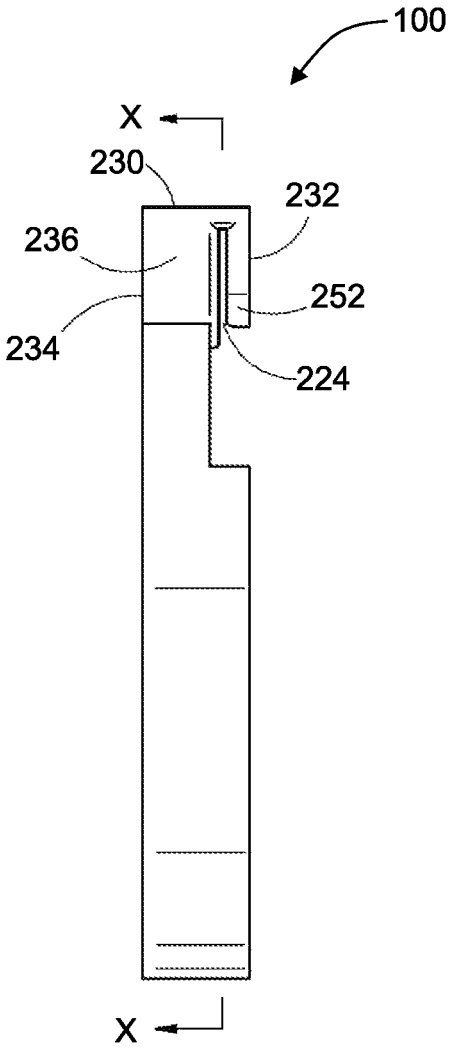
Figure 3C:
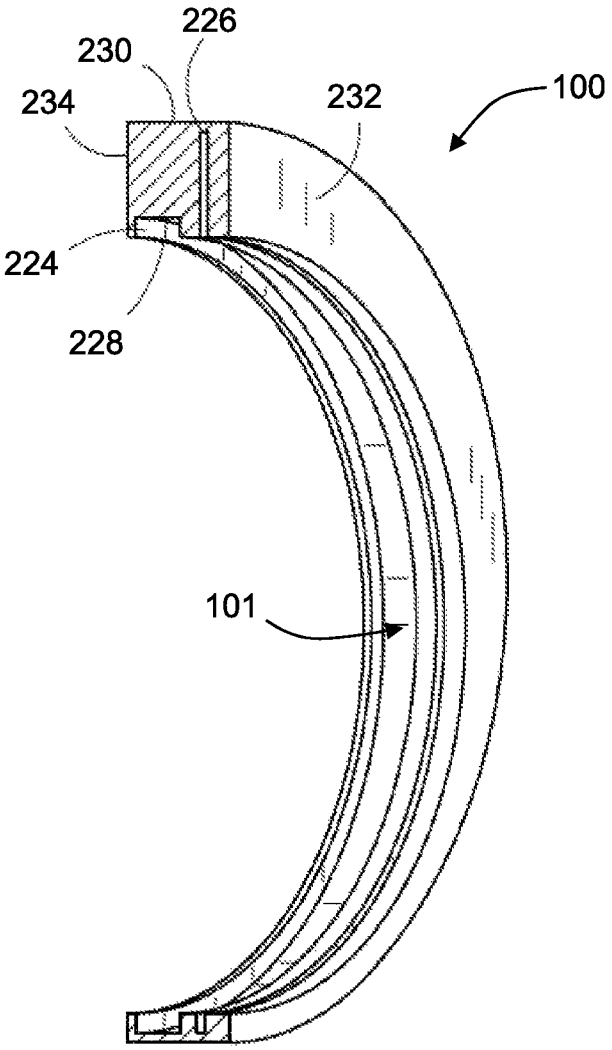
FIG. 3C is a partial cut-away view and FIG. 3D is a cross-sectional view of the example whip shield of FIGS. 3A and 3B.
Figure 3D:
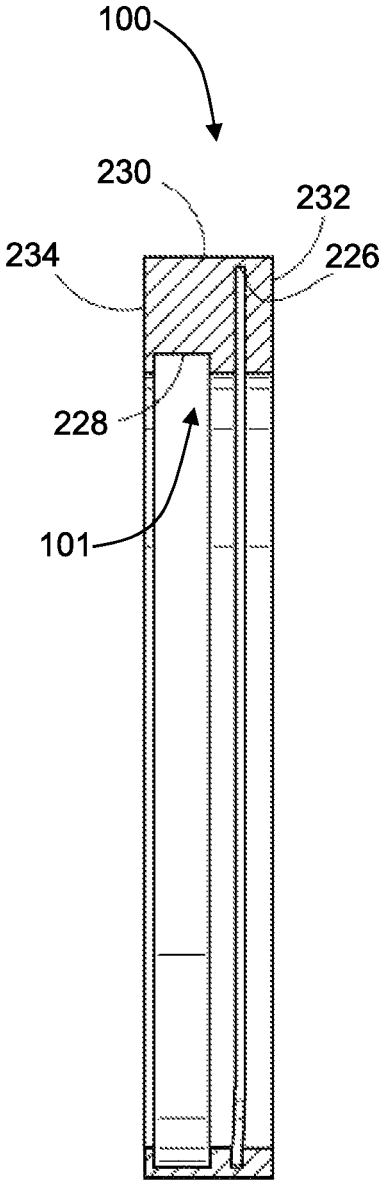

FIG. 3A is an elevated view, FIG. 3B is a side view, FIG. 3C is a cut-way elevated view (along the line V-V of FIG. 3A) and FIG. 3D is a cross-sectional view (along the line V-V of FIG. 3A) of the more complex example of the whip shield 100 as also shown in FIGS. 2A through 2C. The example whip shield 100 is configured as the aforementioned whip ring, with the whip shield configured to allow for the fiber 70 to accumulate on the spool as the fiber is wound thereon.

The example whip shield 100 of FIGS. 3A through 3D includes an inner surface 101 having a first surface portion 226 formed on an inner side of an entry slot 224 that faces the spool 220. The first surface portion 226 is contained within the entry slot 224 provided within the inner side of the whip shield 100. The entry slot 224 surrounds the first surface portion 226 which is aligned with the fiber 70 fed from the feed mechanism 50 such that the loose end 74 of the moving fiber 70, such as would occur during a fiber break event, is directed into the entry slot 224 away from the spool 220 due to centrifugal force and forward motion.

The whip shield 100 has a second surface portion 228 facing the spool 20. The second surface portion 228 is formed laterally offset from the first surface portion 226 in the inner surface 101 of the whip shield 100. The second surface portion 228 has a depth of the slot which is less than the depth of the first surface portion 226 at the entry slot. The first surface portion 226 extends around the inner surface 101 of the whip shield 100 and transitions in a helical shape to the second surface portion 228. The transition from first surface portion 226 to second surface portion 228 preferably occurs within one rotation of the spool 20 or 360 degrees of the whip shield 100. At the point where the first surface portion 226 transitions to the second surface portion 228, the depth of the first and second surfaces 226 and 228 are the same. Thus, the whip shield 100 is substantially circular or ring-shaped on the second surface portion 228 and the entry slot 224 forming the first surface portion 226 leading to the second surface portion 228 is substantially helical-shaped in the axial direction. As such, when the fiber 70 is cut or breaks, the whipping tail 72W of the fiber enters the entry slot 224 and is contained within the first surface portion 226 for about or less than one revolution of the spool 220 and the surrounding whip shield 100 and then transitions to the second surface portion 228 over a 360-degree rotation. The whipping tail 72W of the fiber 70 then remains against second surface portion 228 until the spool 20 is slowed down and stops.

The whip shield 100 is shown having an outer surface 230 extending around the outer perimeter of the whip shield 100, and a first side wall 232 and a second opposite side wall 234 defining the sides of the whip shield 100. The outer surface 230 has a transition surface 236 that is directed radially to connect the transition of the circumferences of the outer surface 230. The first surface portion 226 leading from the entry slot 224 through the transition to the second surface portion 228 preferably has a smooth surface that allows the end of the cut or broken fiber 70 to pass uninterrupted due to centrifugal force and forward motion to minimize any further whipping action or breakage of the fiber 70. Once the end of the fiber 70 passes through the entry slot 224 from the first surface portion 226 to the second surface portion 228, the end of the fiber 70 remains within the second surface portion 228. The second surface portion 228 preferably has a smooth contour that likewise does not cause any further breakage of the fiber 70 while the end of the fiber 70 rotates due to centrifugal force. In the embodiment shown, the second surface 28 is a cylindrical, uninterrupted channel having a circular cross section with a fixed radius and is continuously smooth without interruption such that the moving end of the fiber 70 passes smoothly along the second surface 28 until the spool 20 stops rotating.

The feed mechanism 50 may be operatively coupled to the whip shield 100 such that the feed mechanism 50 and the whip shield 100 move in synchrony (e.g., in tandem) to feed the fiber 70 onto the spool 20. The feed mechanism 50 may be fixedly connected to the whip shield 100 so that the fiber 70 passes through the entry slot 224 when passing from the exit pulley 52 onto the spool 20. According to one embodiment, the spool 20 rotates to wind the fiber 70 onto the spool 20, but is fixed laterally such that it does not move laterally. The feed mechanism 50 moves laterally across the length of the spool 20 to direct the fiber 70 evenly onto the spool 20. In this embodiment, a motor or other actuator (e.g., whip shield drive motor 126) may be employed to move the feed mechanism 50 and whip shield 100 laterally back and forth together. According to another embodiment, the feed mechanism 50 and whip shield 100 may be fixed in place and the spool 20 may be moved laterally left and right with an additional drive motor (not shown).

The side of the whip shield 100 at the entry slot 224 may include a fiber-line cut out portion 252, which provides a way for the fiber 70 to be centered in the entry slot 224 while the fiber 70 is being wound on the spool 20. Because of the fixed relationship and constant contact with the optional fiber guide 54 (which as noted above acts as an entry whip fixture), the whip shield 100 is maintained in a correct position to catch the whipping tail 72W of the fiber 70 when the fiber 70 breaks or is cut. The entry slot 224 is thereby in-line with the exit path of the fiber guide 54 and at the same has approximate proximity and height to provide a smooth transition of the end of the fiber 70. Once the end of the fiber 70 moves forward inside the entry slot 224, rotational forces of the rotating spool 20 keep the end 74 of the fiber 70 pressed outward against the first surface portion 226 and away from the rotating spool 20. The walls of the entry slot 224 extending throughout the first surface portion 226 as best seen in FIGS. 3C and 3D contain the whipping tail 72W of the fiber 70 and guide it in the intended direction.

When the fiber 70 remains intact, it is wound around the spool 20 without passing through the optical path OP of the detection apparatus 140. When a whipping tail 72W forms, it will periodically (or quasi-periodically) pass through the optical path OP over which the laser beam 152 travels, thereby periodically (or quasi-periodically) crossing or partially blocking the light beam. In an example, the optical path OP resides in a plane substantially perpendicular to the plane in which the whipping tail 72W whips. For example, with reference to FIG. 1A, the whipping tail 72W will generally move (whip) in the y-z plane while the optical path OP of the light beam 152 is in the x-direction, thereby intersecting the y-z plane associated with the fiber whip, ensuring that the whipping tail 72W crosses or blocks a portion of the light beam 152 regardless of where along the spool the whipping tail occurs, and in particular regardless of whether the whipping tail 72T is a natural whipping tail or a stray whipping tail.

It is also noted that a stray whipping tail 72W can be detected as described above on what might otherwise be thought to be an empty fiber spool 20. This can occur for example when a fiber spool is being reused but was not properly prepared, e.g., cleaned of all preexisting fiber 70 before winding on a new fiber 70.

In some cases, a stray whipping tail 72W shows up during the fiber winding process because a stray section of fiber 70 got caught in the wound fiber 70 on the spool 20 and creates a stray fiber tail 72T that outwardly extends from the wound fiber. In this case, in the detection processes described below, the fiber winding process carried out on system 10 starts without incident but then suddenly generates an alarm or like warning, indicating a problem related to a stray whipping tail 72W.

Configuration and Operation of the Detection Apparatus

Figure 4:
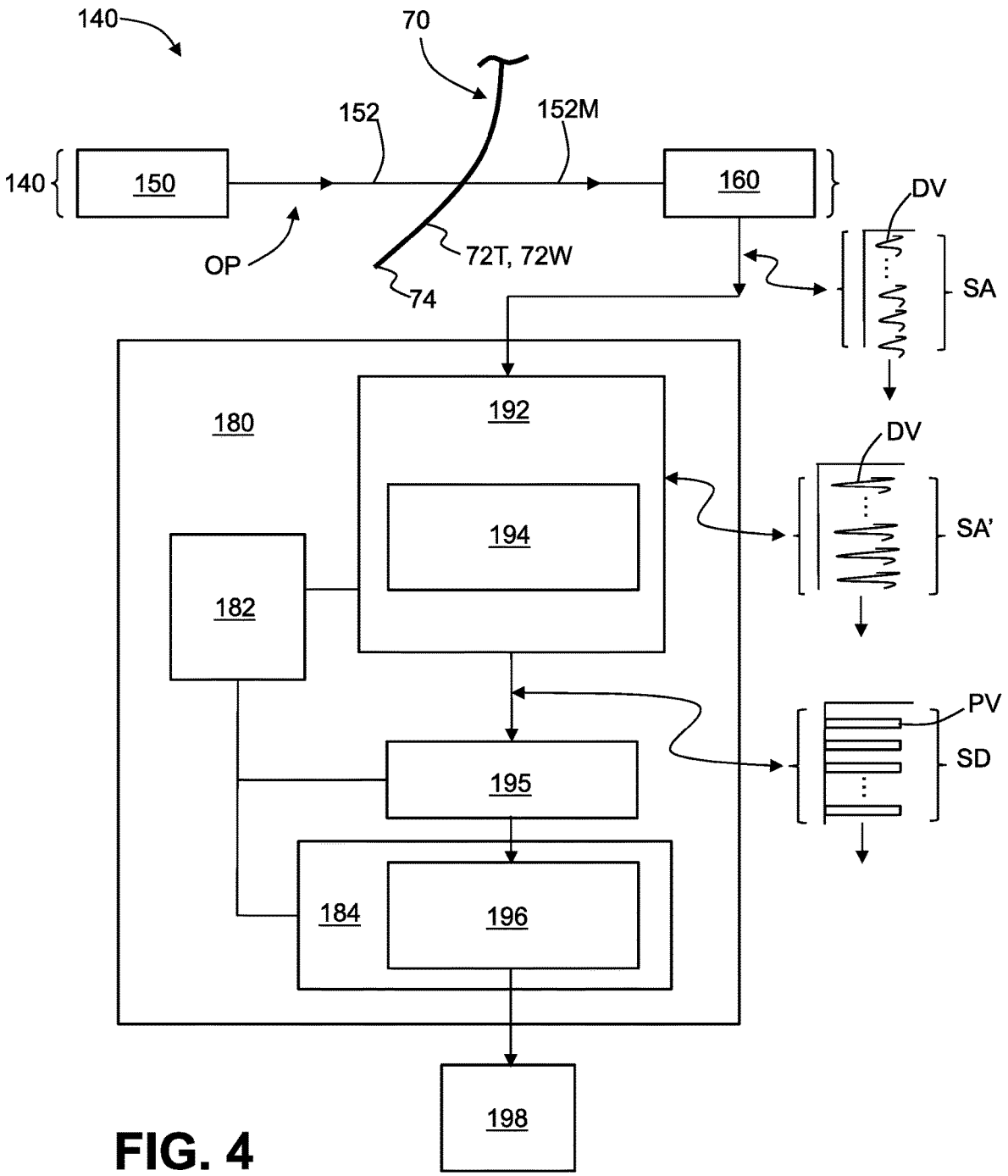
FIG. 4 is a schematic diagram of the whipping tail detection apparatus showing the whipping tail of the fiber passing through light beam and also showing additional details of the controller and some of the processing steps performed by the controller.

The configuration and operation of the detection apparatus 140 is now described with reference to FIG. 4 and FIGS. 5A through 5E. FIG. 4 shows an example configuration for the controller 180. The example configuration includes an amplifier 192, an analog-to-digital (A/D) converter 194 that is shown by way of example as residing with the amplifier, a PLC high-speed input card 195, a PLC 196 and an output unit 198. In an example, the PLC 196 is part or constitutes the processor 184.

In the operation of the detector apparatus 140, the whipping tail 72W passes through at least a portion of the optical path OP and thus through at least a portion of the laser beam 152. As described above, this results in the whipping tail 72W periodically or quasi-periodically diminishing the intensity of the light beam 152, thereby defining a modulated light beam 152M.

Figures 5A, 5B, 5C, 5D:
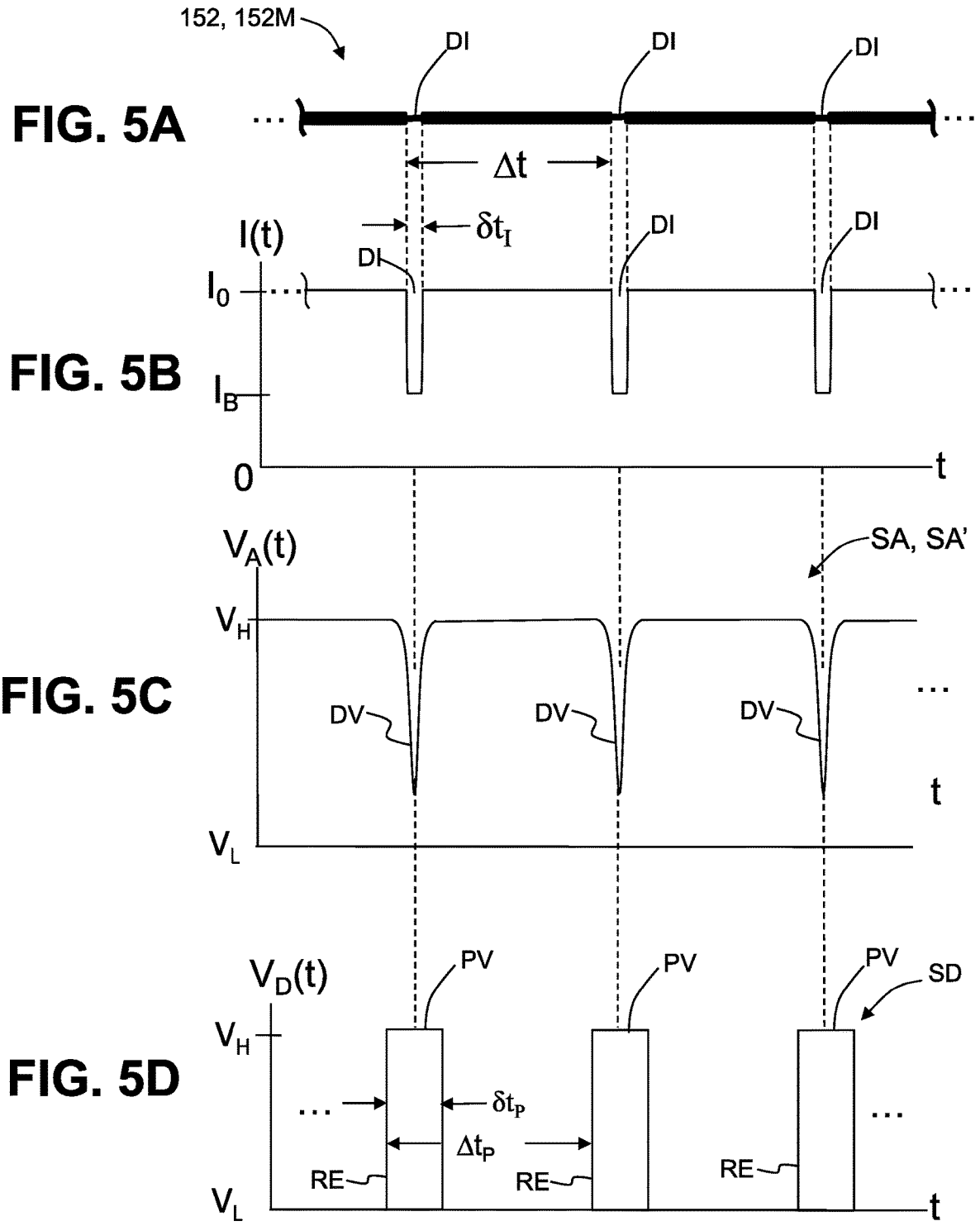
FIG. 5A is a schematic diagram of the light beam showing intensity dips (DI) in the light beam intensity caused by the whipping tail crossing the light beam, wherein the intensity dips transform the constant-intensity light beam into a modulated light beam.
FIG. 5B is an idealized plot of the intensity I(t) versus time for the modulated light beam of FIG. 5A, showing the location of the intensity dips as defined by the corresponding drop in light intensity caused by the whipping tail passing through the light beam.
FIG. 5C is an idealized plot of the analog detector signal SA in the form of an analog voltage $V_A(t)$ versus time t as generated by the light detector detecting the modulated light beam.
FIG. 5D is an idealized plot of the digital detector signal SD in the form of a voltage $V_D(t)$ versus time t as generated by the A/D converter, where the digital detector signal comprises a series of digital pulses that correspond to whipping tail passing through the light beam.

FIG. 5A is a schematic diagram of the light beam 152 showing intensity dips DI formed in the light beam when the whipping tail 72W passes through the light beam to form the modulated light beam 152M. The intensity dips DI are highly idealized representations of locations of diminished light beam intensity. FIG. 5B is an idealized plot of the intensity I(t) versus time t for the light beam 152 and illustrates the intensity dips DI as caused by the whipping tail 72W. The intensity dips DI represent regions in the intensity I(t) where the intensity drops from the relatively high "normal" or "nominal" intensity $I_0$ in the absence of the temporary blocking of a portion of the light beam by the whipping tail 72W. In the case where the whipping tail 72W can block the entire light beam 152, then the low value $I_B$ can be substantially zero. Such an embodiment would require a very small beam diameter DB, which for many applications may be unnecessary. The light beam 152 that includes intensity dips DI constitutes the aforementioned modulated light beam 152M. The intensity dips DI have a temporal width of $\delta t_1$ that represent the amount of time the whipping tail 72W blocks at least a portion of the light beam 152. Adjacent intensity dips DI have a temporal spacing (period) of $\Delta t_1$ (depicted as $\Delta t$ in FIGS. 5*a* and 5B). The intensity dip period $\Delta t_1$ defines an intensity dip frequency $f_I=1/\Delta t_1$.

The light beam 152 has a cross-sectional area $A_L$. For a light beam 152 having a diameter DB of 2.5 mm, the cross-sectional area $A_L$ is given by $A_L=\pi(DB/2)^2\approx 5\ mm^2$. For a fiber 70 having a diameter of 250 microns or 0.25 mm, the whipping tail defines a fiber tail blocking area ("blocking area") $A_B$ that blocks the light beam 152. The blocking area $A_B$ can be approximated by a rectangle of length DB and width of 0.25 mm, which gives a blocking area $A_B=(2.5\ mm)(0.25\ mm)=0.625\ mm^2$, or about 8× smaller than the light beam area $A_L$. This means that in the given example, the light intensity I(t) is diminished by about 12% when the whipping tail 72W is centered in a circular light beam (i.e., maximum blockage). For a circular light beam 152, the beam intensity I(t) for the intensity dip DI decreases from the normal intensity $I_0$ gradually to a minimum $I_B$ and then gradually increases back to the normal intensity as the whipping tail 72W cuts across the light beam 152. In practice, the percentage of maximum light blockage by the whipping tail 72W can be substantially smaller, e.g., just a few percent, such as when the light beam 152 is diverging and has a much larger beam diameter DB at the location where the whipping tail 72W crosses the light beam.

The intensity dip width $\delta t_1$ of an intensity dip DI is determined by how fast the whipping tail 72W passes through the light beam 152. The speed of the whipping tail 72W is determined by the rotation rate of the spool 20, which in turn is determined by the line speed of the fiber 70 being wound on the spool. For a rotation rate of the spool 20 of 120 Hz (i.e., 120 RPS), it takes on the order of 10 microseconds (μs) for the whipping tail 72W to pass through a beam diameter DB of 1.5 mm. In some examples, the temporal spacing $\Delta t_1$ between adjacent intensity dips DI can be on the order of 1 to 10 milliseconds, or about 100× to 1000× of the intensity dip width $\delta t_1$.

The light detector 160 detects the modulated light beam 152M and in response generates an analog electrical detector signal ("analog signal") SA. FIG. 5C is a plot of analog voltage $V_A(t)$ versus t, wherein the plot is representative of an example analog signal SA. The analog voltage $V_A(t)$ ranges from a high voltage $V_H$ associated with detecting the normal intensity $I_0$ in the modulated light beam to a low voltage $V_L$ associated with detecting the intensity dips DI that form the blocked intensity $I_B$, as shown in FIG. 5B. The analog signal SA thus includes a series of voltage dips DV that correspond to the series of intensity dips DI.

The amplifier 192 is used to amplify the initial detector signal SA to form an amplified analog signal SA' to make edge detection easier when forming the digital signal. The amplified analog signal SA' includes amplified voltage (signal) dips DV. In an example, the analog voltage signal SA and it amplified version SA' remains internal to the amplifier, i.e., are formed as part of the detection step and are not outputted; these signals are shown in FIG. 5B by way of completeness and for ease of understanding.

The amplified analog signal SA' is then sent to the A/D converter 194, which receives and converts the amplified analog signal SA' into a digital electrical detector signal ("digital signal") SD, which can then be processed by the (digital) PLC 196. FIG. 5D is an idealized plot of the digital voltage $V_D(t)$ versus time t representative of an example digital signal SD. Note that part of the A/D signal conversion includes turning the analog voltage dips DV of FIG. 5C into digital voltage pulses ("digital pulses") PV in the digital signal SD. Thus, the digital pulses PV are ultimately defined by the intensity dips DI, though the digital pulses have a substantially larger pulse width $\delta t_P$ than the intensity dip width $\delta t_1$ to make the detection process easier. In an example, the pulse width $\delta t_P$ is set by the amplifier (e.g., via programming) to be a few milliseconds (e.g., 1 ms to 5 ms). The PLC high-speed input card 195 that resides between the amplifier 192 and the PLC 196 enables high-speed input of the digital signal SD to the PLC 196.

The digital pulses PV of the digital signal SD have a timing, e.g., pulse frequency $f_P$ (pulses per second, or Hertz) and a pulse period $\Delta t_P=1/f_P$ (seconds/pulse). The digital pulses PV also have the aforementioned pulse width $\delta t_P$. In an example, the pulse frequency $f_P$ or pulse period $\Delta t_P$ is measured from an edge (e.g., rising edge) of the digital pulses PV. While the pulse width $\delta t_P$ is chosen to be substantially greater than the intensity dip pulse width $\delta t_1$ to facilitate signal processing, the pulse period $\Delta t_P$ and pulse frequency $f_P$ are respectively defined by and are ideally equal to the intensity dip period $\Delta t_1$ and thus the intensity dip frequency $f_I$.

While the digital pulses PV can take the form of a voltage as shown FIG. 5D, they can be referred to as "electrical pulses," or "digital electrical pulses," since in general they can also be represented as current pulses based on the well-known electricity relationship V=IR, where I is current and R is resistance In an example, if variations in the pulse timing exceed a certain limit, the timing can be averaged over a select number of digital pulses PV. Also, if the pulse timing has substantial variations relative to an expected periodic pulse timing, it can be an indication of a false detection, e.g., something other than the whipping tail 72W passing through the light beam 152. For example, if loose debris were to be trapped in the containment region 80, the loose debris can remain airborne due to the air pressure and air flow generated within the containment region by the rotating spool 20. The airborne debris can end up traversing the light beam 152 in a less periodic manner than the whipping tail 72W.

Figure 5E:
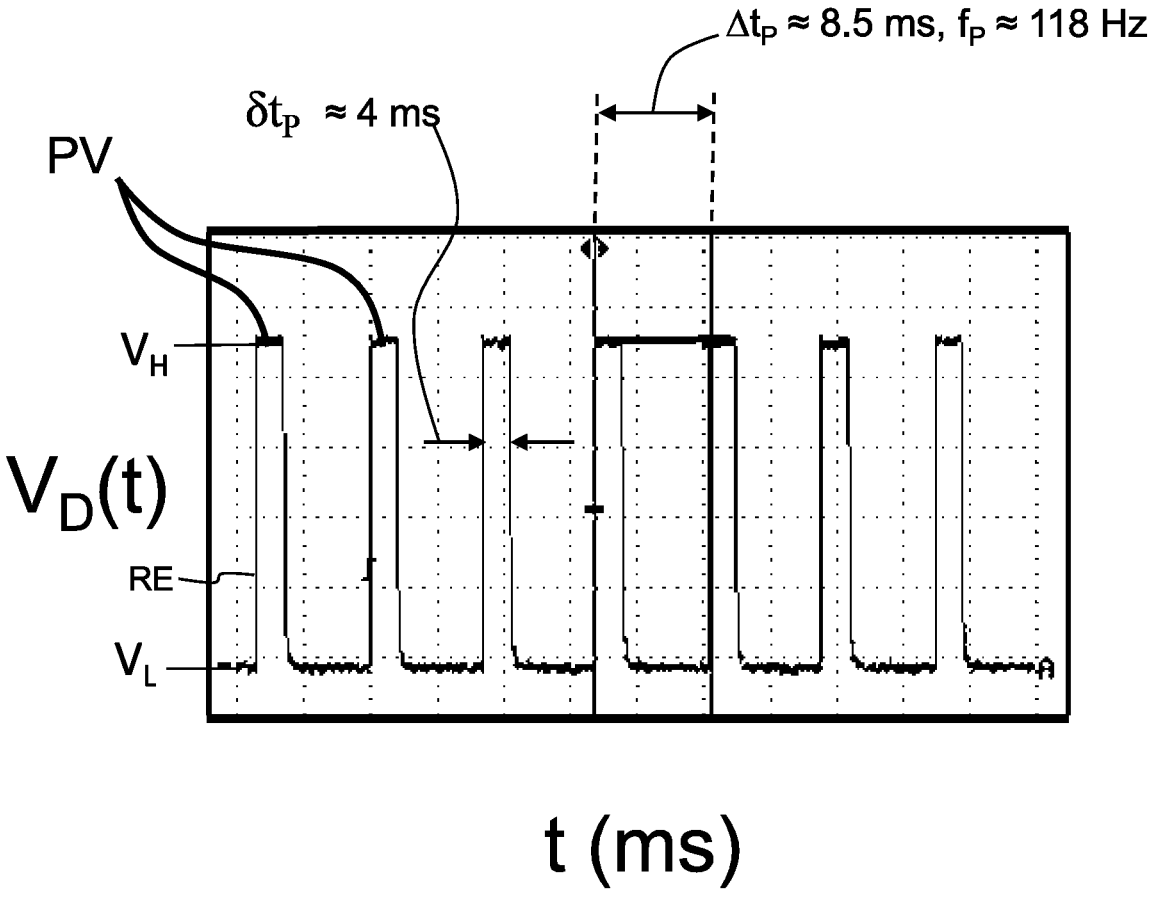
FIG. 5E is plot of the digital voltage $V_D(t)$ similar to FIG. 5D, but taken from an actual oscilloscope trace obtained using the detection apparatus during an actual operation of the fiber winding system of FIG. 1A with a whipping tail present.

FIG. 5E is a plot of the digital voltage $V_D(t)$ versus time t (milliseconds) similar to that shown in FIG. 5D, but taken from an actual oscilloscope trace of the output of the amplifier 192. The plot shows the digital pulses PV that correspond to the intensity dips DI formed in the laser beam 152 for system 10 operating at a line speed of 60 meters per second. The response of the optical sensor 161 of the light detector 160 was 15 microseconds (μs). The pulse width (i.e., intensity dip width) $\delta t_P$ is about 4 ms, while the pulse spacing (i.e., intensity dip spacing) $\Delta t_P$ is about 8.5 ms and the pulse frequency $f_P$ is about 118 Hz.

Signal Processing Using the PLC

In an example, the PLC 196 is configured with instructions embodied in a non-transitory computer-readable medium (e.g., software or firmware) to analyze the digital signal SD to determine the presence of a whipping tail 72W. In an example, the PLC 196 is part of or constitutes the aforementioned processor 184. The resulting output from the PLC is sent to the output 198 (e.g., a computer display), which need not be part of the controller 180. The memory 182 can be operably configured in the controller 180 to store information (e.g., one or more of the various signals involved in the signal processing, operating parameters of system 10, etc.) and facilitate the signal processing as known in the art. In an example, the output 198 displays the operating condition of the system 10, and specifically whether a whipping tail 72W has been detected or if the system 10 is operating normally.

In an example, the PLC 196 is configured to poll the digital signal SD at a first polling interval (e.g., 1000 points every 2 milliseconds) to generate a first data array. Note that this polling rate is sufficient to detect the individual digital pulses PV, which can have pulse widths δt of a few milliseconds as defined by the amplifier 192.

The first data array is then fed into a second data array, which is analyzed using a longer polling interval suitable for detecting and counting the rising edges RE of the digital pulses PV. In an example, the polling for the second array is performed using 1000 points every 200 milliseconds.

Once the timing information of the digital pulses PV for the digital signal SD is established based on the detection of the rising edges RE, it is compared to an estimated timing for the digital pulses of the digital signal based on select operating parameters of system 10. These select operating parameters can include the line speed of the fiber 70 and the rotation rate of the spool 20. Note that the process of forming the first and second arrays is ongoing, i.e., repeats itself, so that once the data from the first array is transferred to the second array the first array is re-populated with new measurement data, which is then used to re-populate the second array, etc.

In an example, the second array is analyzed to detect and count the number rising edges RE of the digital pulses PV for the given number of digital pulses in the second array. The count of the rising edges RE ("rising-edge count") is then compared to a threshold rising-edge count, which can be determined empirically or by calculation. The rising edge count can also (or alternatively) be compared to an expected rising-edge count based on the line (fiber) speed. For example, it was found in one experiment that a given line speed resulted in a pulse spacing (period) of $\Delta t_P$=10 ms, so that the second array would be expected to count 20 rising edges associated with twenty digital pulses PV within the example 200 millisecond time frame for the polling of the second array. In this particular example, the threshold rising-edge count can be set at a lower limit of 15 or defined as a range between 15 and 25.

Ideally, there would be no rising edges RE and no digital pulses PV if nothing passes through the light beam 152. In practice, the operation of system 10 is less than ideal. For example, as noted above, there can be debris residing in the containment region 80. This debris can pass through the light beam 152 and trigger a small count of digital pulses. Thus, in an example, setting the particular timing threshold (e.g., rising-edge count) can be based on experiments conducted by intentionally forming a whipping tail 72W and then making measurements for a variety of operating parameters for the system 10. This can include replicating non-ideal operating conditions or characterizing existing non-ideal operating conditions to understand how false counts can arise, such as by intentionally introducing debris into the system 10.

In addition to the receiving and processing the digital signal SD to establish the timing of the digital pulses PV, the PLC also knows (or has access to, via memory 82) a variety of operating parameters of the system 10, such as the line speed of the fiber 70, the once-per-revolution frequency of the rotating spool 20, as well as the rotation rate in RPM or RPS. The spool rotation rate (speed) is defined by the spool drive motor 30, which can be in communication with the controller 180 to provide this information to the controller.

The line speed of the fiber 70 (which can be set via the controller 180) can be used to estimate a pulse timing threshold to be compared to the actual measured pulse timing to determine if a whipping tail 72W is present.

Consider an example configuration of the system 10 wherein the line speed is 50 meters per second and the winding surface 22 of the spool 20 has a diameter of 0.2 meters. For these parameters, the spool rotation rate is about 84 rotations per second, or one rotation in 0.012 second (i.e., 12 milliseconds). This is the spool rotation rate required to keep up with the line speed so that the fiber 70 is taken up on the spool 20 smoothly. If a whipping tail 72W forms, it can be expected to cross the light beam 152 every 12 milliseconds or so, or 84 times per second. Note that the selected timing threshold for the digital pulses PV need not be a constant value, but can change with time since the effective diameter of the wound fiber 70 on the spool 20 changes, thereby changing the timing of the whipping tail 72W. Thus, in one example, the select timing threshold is tied to the amount (e.g., length) of fiber 70 wound onto the spool 20.

In the example, a lower threshold on the pulse period $\Delta t_P = 1/f_P$ can be set to 9 milliseconds, or alternatively, the threshold can be a range such as from 9 milliseconds to 15 milliseconds. Likewise, a lower threshold on pulse frequency $f_P$ can be set to 77 pulses per second, or alternatively can be set to a range, such as from 77 pulses per second to 94 pulses per second. Using a threshold range is convenient in cases where there is some variation in the digital pulse timing. In an example, a measured pulse timing that falls within the timing range indicates the presence of a whipping tail 72W. In another example, a measured pulse timing that exceeds a select timing value (e.g., pulse count) indicates the presence of a whipping tail 72W. When the presence of a whipping tail 72W is detected, the controller 180 can be configured to stop the spool 20 from rotating, e.g., by sending a stop signal to the spool drive motor 30. The controller 180 can also be programmed to generate an alarm to indicate the detection of a whipping tail 72W.

Generally, the PLC 196 can be programmed to analyze the digital pulses PV in the digital signal SD to determine the pulse timing, typically defined using the period $\Delta t_P$ or the pulse frequency $f_P$. The digital pulse timing can be compared to a timing threshold (e.g., single value or range) based upon the operable parameters of the system 10 that yield anticipated conditions when there is a whipping tail 72W. Note that the pulse timing defines a pulse count in the form of the pulse frequency $f_P$ (counter per unit time, such as counter per second) so that the timing threshold also includes a pulse count (which in turn corresponds to the rising-edge count).

This is just one example of how the timing threshold (e.g., for the pulse period $\Delta t_P$ and pulse frequency $f_P$) can be can be established and employed for the given operating parameters of system 10. The above select numerical values and ranges are provide by way of example based on example conditions, and the actual numerical values and ranges used will typically depend on the particular configuration of system 10 and its performance.

In addition, it follows naturally from the above systems and methods that multiple whipping tails 72W can be detected during a given fiber winding process. For example, the periodic or quasi-periodic signals associated with different ones of multiple whipping tails 72W can be readily extracted using known signal processing methods and then processed and analyzed separately as described above.

Diagnostic Methods

The operational status of system 10 can be monitored using the detection apparatus 140 using diagnostic methods. In one diagnostic method, the system 10 is checked when known cuts to the fiber 70 are made. For example, when the fiber 70 is finished being wound on the spool 20, the fiber is automatically cut, resulting in the formation of the natural tail 72T and thus a natural whipping tail 72W. Since the controller 180 knows when this automatic fiber cut happens, it can look for the corresponding digital pulses PV that indicate the presence of a natural whipping tail 72W. If there is no pulsed signal PV detected when the automatic cut occurs, then there may be a problem with the detection apparatus 140 or the system 10 in general (e.g., the automatic fiber cut did not actually happen).

In another diagnostic method, the system 10 is checked by running an empty spool 20 to see if any digital pulses are generated. If digital signal pulses are detected, then it could indicate a stray whipping tail 72W on the empty spool, which is a possibility that was discussed above. If the empty spool 20 is checked and a stray fiber is detected, it can be removed so that the empty spool is ready to receive new fiber 70. If no stray fiber is detected, then it could indicate a false detection issue that needs to be diagnosed.

In another method, the detection apparatus 140 is checked for the generation of a "stuck on" signal, i.e., a constant (DC) "high:" signal. When the fiber 70 is winding properly, there should be no digital pulses PV. On the other hand, when the fiber 70 is intentionally cut to form a fiber tail, there should be digital pulses PV as described above. A signal that is "stuck on" has a constant (DC) digital signal that forms one long, steady digital pulse PV (e.g., with $V=V_H$). Such a signal can indicate a system problem.

Clauses of the Description

Clause 1 of the description discloses: A method of detecting a whipping tail when winding a fiber onto a rotating spool having a winding surface and a rotational speed, comprising:

a) winding the fiber onto the winding surface of the rotating spool to form a wound fiber thereon, wherein the whipping tail outwardly extends from the wound fiber;

b) directing a light beam so that the whipping tail at least partially intersects the light beam either periodically or quasi-periodically due to the rotating spool to create intensity dips in the light beam to form a modulated light beam;

c) converting the modulated light beam into a digital electrical signal made up of electrical pulses having a timing defined by the intensity dips; and d) comparing the timing of the electrical pulses to an estimated timing based on the rotational speed of the rotating spool to detect the whipping tail.

Clause 2 of the description discloses:

The method according to clause 1, wherein the whipping tail is formed by either:

a section of fiber different from the wound fiber that outwardly extends from the wound fiber;

a section of optical fiber from the wound fiber that outwardly extends from the wound fiber;

intentionally or unintentionally cutting the wound fiber; or intentionally or unintentionally breaking the wound fiber.

Clause 3 of the description discloses:

The method according to clauses 1 or 2, wherein converting the modulated light beam into a digital electrical signal comprises:

converting the modulated light beam to an analog electrical signal that includes a series of signal dips each having an intensity dip pulse width;

amplifying the analog electrical signal to form an amplified electrical signal that includes amplified signal dips; and converting the amplified analog electrical signal into the digital electrical signal wherein the electrical pulses have a pulse width substantially greater than the intensity dip pulse width.

Clause 4 of the description discloses:

The method according to any of clauses 1-3, wherein the directing the light beam comprises directing the light beam to be parallel to the rotational axis of the rotating spool.

Clause 5 of the description discloses:

The method according to any of clauses 1-4, wherein the winding of the fiber onto the winding surface comprises directing the fiber into a containment region defined at least in part by a whip shield operably disposed relative to the rotating spool, and wherein the directing of the light beam comprises passing the light beam through the containment region.

Clause 6 of the description discloses:

A method of detecting a whipping tail in a fiber winding system, comprising:

a) winding a fiber onto a winding surface of a rotating spool having a rotation axis and opposing outer flanges by passing the fiber through a containment region formed between the rotating spool and a containment shield operably disposed relative to and spaced apart from the winding surface, thereby forming on the winding surface a wound fiber having a wound fiber surface, and wherein the whipping tail extend outwardly from the wound fiber surface;

b) directing a light beam proximate the rotating spool and through the containment region such that the whipping tail substantially periodically passes through at least a portion of the light beam to form intensity dips in the light beam to form from the light beam a modulated light beam;

c) converting the modulated light beam into a digital signal comprising electrical pulses having an electrical pulse timing as defined by the intensity dips; and d) comparing the electrical pulse timing to an estimated timing of the whipping tail based on at least one operational parameter of the fiber winding system.

Clause 7 of the description discloses:

The method according to clause 6, wherein directing the light beam comprises sending the light beam over an optical path that runs generally parallel to the rotation axis and outside of and proximate to the opposing outer flanges of the spool.

Clause 8 of the description discloses:

The method according to clause 6 or 7, wherein at the least one operational parameter comprises one or more of: a line speed of the fiber and a rotation rate of the spool.

Clause 9 of the description discloses:

The method according to any of clauses 6-8, wherein the spool has an axial length and a circumference, and wherein the whip shield surrounds the circumference of the spool over at least a portion of the length.

Clause 10 of the description discloses:

The method according to any of clauses 6-9, wherein each of the electrical pulses has a pulse width and a rising edge, and wherein said comparing of act d) comprises:

i) polling the electrical pulses at a first rate selected to identify the electrical pulses, to form first data;

ii) polling the first data at a second polling rate selected to detect the rising edges of the electrical pulses in the first data, to form second data; and iii) determining locations of the rising edges of the electrical pulses in the second data to establish the electrical pulse timing.

Clause 11 of the description discloses:

The method according to any of clauses 6-10, further comprising:

changing the estimated timing of the whipping tail based on an amount of the wound fiber on the spool.

Clause 12 of the description discloses:

The method according to any of clauses 6-11, wherein the act c) of converting the modulated light beam into a digital signal comprises:

converting the light beam into an analog electrical signal that includes a series of signal dips each having an intensity dip pulse width;

amplifying the analog electrical signal to form an amplified electrical signal that includes amplified signal dips; and converting the amplified analog electrical signal into the digital signal wherein the electrical pulses have a pulse width substantially greater than the intensity dip pulse width.

Clause 13 of the description discloses:

The method according to any of clauses 6-12, wherein the directing the light beam comprises sending light from a light emitter through a first fiber bundle.

Clause 14 of the description discloses:

The method according to clause 13, further comprising receiving a portion of the light beam with a second fiber bundle.

Clause 15 of the description discloses:

The method according to clause 14, further comprising the first fiber bundle emitting diverging light from an output end and further comprising substantially collimating the diverging light to form a substantially collimated light beam.

Clause 16 of the description discloses:

The method according to clause 15, further comprising substantially focusing the substantially collimated light beam onto an input end of the second fiber bundle.

Clause 17 of the description discloses:

The method according to any of clauses 6-16, wherein the estimated timing of the whipping tail comprises a timing range, and wherein the electrical pulse timing falling with the timing range corresponds to a presence of the whipping tail.

Clause 18 of the description discloses:

The method according to any of clauses 6-17, wherein the whipping tail is formed by either:

a stray fiber caught in the wound fiber;

unintentionally or intentionally cutting the wound fiber; or unintentionally or intentionally breaking the wound fiber.

Clause 19 of the description discloses a fiber winding system for winding a fiber and that can detect a whipping tail, comprising:

a) a spool configured to rotate about a rotation axis, the spool having a winding surface on which the fiber is wound to form a wound fiber, wherein the whipping tail extends outwardly from the wound fiber;

b) a feed mechanism configured to feed the fiber onto the spool surface at a line speed;

c) a whip shield operably disposed relative to the spool to form a containment region between the spool and the whip shield;

d) a whipping tail detection apparatus comprising:

i) a light source configured to emit a light beam over an optical path that is substantially parallel to the rotation axis, that traverses the containment region so that the whipping tail if present substantially periodically passes through at least a portion of the light beam due to the rotation of the spool to form a series of intensity dips in the light beam to form therefrom a modulated light beam; and ii) a light detector configured to detect the modulated light beam and form therefrom an analog electrical signal having a series of signal dips defined by the series of intensity dips; and iii) a controller configured to receive and process the analog electrical signal to establish the presence of the whipping tail by comparing a timing of the signal dips to an estimated whipping tail timing.

Clause 20 of the description discloses:

The fiber winding system according to clause 19, wherein the estimated whipping tail timing is based on either the rotation rate of the rotating spool or the line speed of the fiber and is provided to the controller as an estimated electrical pulse timing.

Clause 21 of the description discloses:

The fiber winding system according to clause 19, wherein the controller comprises:

an analog-to-digital (A/D) convertor operably connected to the light detector and configured to receive the analog electrical signal and form therefrom a digital electrical signal comprising electrical pulses having an electrical pulse timing representative of a timing of the signal dips; and a programmable logic controller (PLC) operably connected to the A/D converter and configured to receive the digital electrical signal and compare the electrical pulse timing to the estimated whipping tail timing.

Clause 22 of the description discloses:

The fiber winding system according to clause 21, wherein each of the electrical pulses has a pulse width and a rising edge, and wherein the PLC is configured to:

poll the electrical pulses at a first rate selected to identify the electrical pulses to form first data;

poll the first data at a second polling rate selected to rising edges of the electrical pulses in the first data, to form second data; and determine locations of the rising edges of the electrical pulses in the second data to establish the electrical pulse timing.

Clause 23 of the description discloses:

The fiber winding system according to clause 21, wherein the controller further comprises:

an amplifier operably disposed upstream of the A/D converter and configure to amplify the analog electrical signals before they are provided to the A/D converter; and a PLC high-speed input card operably disposed between the A/D converter and the PLC and configured to input the digital electrical signal to the PLC.

Clause 24 of the description discloses:

The fiber winding system according to any of clauses 19-23, wherein the light source comprises a first fiber bundle and the light detector comprises a second fiber bundle.

Clause 25 of the description discloses:

The fiber winding system according clause 24, wherein the light source further comprises a light-source optical system configured to form substantially collimated light from a diverging light emitted by the first fiber bundle, and wherein the light detector further comprises a light-detector optical system configured to form from the substantially collimated light substantially focused light directed to an input end of the second fiber bundle.

Clause 26 of the description discloses:

The fiber winding system according to any of clauses 19-25, wherein the estimated whipping tail timing comprises a timing range, and wherein the electrical pulses falling with the timing range corresponds to the presence of the whipping tail.

The described embodiments are preferred and/or illustrated, but are not limiting. Various modifications are considered within the purview and scope of the appended claims.

What is claimed is:

1. A method of detecting a whipping tail when winding a fiber onto a rotating spool having a winding surface and a rotational speed, comprising:

a) winding the fiber onto the winding surface of the rotating spool to form a wound fiber thereon, wherein the whipping tail outwardly extends from the wound fiber;

b) directing a light beam so that the whipping tail at least partially intersects the light beam either periodically or quasi-periodically due to the rotating spool to create intensity dips in the light beam to form a modulated light beam;

c) converting the modulated light beam into a digital electrical signal made up of electrical pulses having a timing defined by the intensity dips; and d) comparing the timing of the electrical pulses to an estimated timing based on the rotational speed of the rotating spool to detect the whipping tail.

2. The method according to claim 1, wherein the whipping tail is formed by either:

a section of fiber different from the wound fiber that outwardly extends from the wound fiber;

a section of optical fiber from the wound fiber that outwardly extends from the wound fiber;

intentionally or unintentionally cutting the wound fiber; or intentionally or unintentionally breaking the wound fiber.

3. The method according to claim 1, wherein converting the modulated light beam into a digital electrical signal comprises:

converting the modulated light beam to an analog electrical signal that includes a series of signal dips each having an intensity dip pulse width;

amplifying the analog electrical signal to form an amplified electrical signal that includes amplified signal dips; and converting the amplified analog electrical signal into the digital electrical signal wherein the electrical pulses have a pulse width substantially greater than the intensity dip pulse width.

4. The method according to claim 1, wherein the directing the light beam comprises directing the light beam to be parallel to the rotational axis of the rotating spool.

5. The method according to claim 1, wherein the winding of the fiber onto the winding surface comprises directing the fiber into a containment region defined at least in part by a whip shield operably disposed relative to the rotating spool, and wherein the directing of the light beam comprises passing the light beam through the containment region.

6. A method of detecting a whipping tail in a fiber winding system, comprising:

a) winding a fiber onto a winding surface of a rotating spool having a rotation axis and opposing outer flanges by passing the fiber through a containment region formed between the rotating spool and a containment shield operably disposed relative to and spaced apart from the winding surface, thereby forming on the winding surface a wound fiber having a wound fiber surface, and wherein the whipping tail extend outwardly from the wound fiber surface;

b) directing a light beam proximate the rotating spool and through the containment region such that the whipping tail substantially periodically passes through at least a portion of the light beam to form intensity dips in the light beam to form from the light beam a modulated light beam;

c) converting the modulated light beam into a digital signal comprising electrical pulses having an electrical pulse timing as defined by the intensity dips; and d) comparing the electrical pulse timing to an estimated timing of the whipping tail based on at least one operational parameter of the fiber winding system.

7. The method according to claim 6, wherein directing the light beam comprises sending the light beam over an optical path that runs generally parallel to the rotation axis and outside of and proximate to the opposing outer flanges of the spool.

8. The method according to claim 6, wherein at the least one operational parameter comprises one or more of: a line speed of the fiber and a rotation rate of the spool.

9. The method according to claim 6, wherein the spool has an axial length and a circumference, and wherein the whip shield surrounds the circumference of the spool over at least a portion of the length.

10. The method according to claim 6, wherein each of the electrical pulses has a pulse width and a rising edge, and wherein said comparing of act d) comprises:

i) polling the electrical pulses at a first rate selected to identify the electrical pulses, to form first data;

ii) polling the first data at a second polling rate selected to detect the rising edges of the electrical pulses in the first data, to form second data; and iii) determining locations of the rising edges of the electrical pulses in the second data to establish the electrical pulse timing.

11. The method according to claim 6, further comprising:

changing the estimated timing of the whipping tail based on an amount of the wound fiber on the spool.

12. The method according to claim 6, wherein the act c) of converting the modulated light beam into a digital signal comprises:

converting the light beam into an analog electrical signal that includes a series of signal dips each having an intensity dip pulse width;

amplifying the analog electrical signal to form an amplified electrical signal that includes amplified signal dips; and converting the amplified analog electrical signal into the digital signal wherein the electrical pulses have a pulse width substantially greater than the intensity dip pulse width.

13. The method according to claim 6, wherein the directing the light beam comprises sending light from a light emitter through a first fiber bundle.

14. The method according to claim 13, further comprising receiving a portion of the light beam with a second fiber bundle.

15. The method according to claim 14, further comprising the first fiber bundle emitting diverging light from an output end and further comprising substantially collimating the diverging light to form a substantially collimated light beam.

16. The method according to claim 15, further comprising substantially focusing the substantially collimated light beam onto an input end of the second fiber bundle.

17. The method according to claim 6, wherein the estimated timing of the whipping tail comprises a timing range, and wherein the electrical pulse timing falling with the timing range corresponds to a presence of the whipping tail.

18. The method according to claim 6, wherein the whipping tail is formed by either:

a stray fiber caught in the wound fiber;

unintentionally or intentionally cutting the wound fiber; or unintentionally or intentionally breaking the wound fiber.

19. A fiber winding system for winding a fiber and that can detect a whipping tail, comprising:

a) a spool configured to rotate about a rotation axis, the spool having a winding surface on which the fiber is wound to form a wound fiber, wherein the whipping tail extends outwardly from the wound fiber;

b) a feed mechanism configured to feed the fiber onto the spool surface at a line speed;

c) a whip shield operably disposed relative to the spool to form a containment region between the spool and the whip shield;

d) a whipping tail detection apparatus comprising:

i) a light source configured to emit a light beam over an optical path that is substantially parallel to the rotation axis, that traverses the containment region so that the whipping tail if present substantially periodically passes through at least a portion of the light beam due to the rotation of the spool to form a series of intensity dips in the light beam to form therefrom a modulated light beam; and ii) a light detector configured to detect the modulated light beam and form therefrom an analog electrical signal having a series of signal dips defined by the series of intensity dips; and iii) a controller configured to receive and process the analog electrical signal to establish the presence of the whipping tail by comparing a timing of the signal dips to an estimated whipping tail timing.

20. The fiber winding system according to claim 19, wherein the estimated whipping tail timing is based on either the rotation rate of the rotating spool or the line speed of the fiber and is provided to the controller as an estimated electrical pulse timing.

21. The fiber winding system according to claim 19, wherein the controller comprises:

an analog-to-digital (A/D) convertor operably connected to the light detector and configured to receive the analog electrical signal and form therefrom a digital electrical signal comprising electrical pulses having an electrical pulse timing representative of a timing of the signal dips; and a programmable logic controller (PLC) operably connected to the A/D converter and configured to receive the digital electrical signal and compare the electrical pulse timing to the estimated whipping tail timing.

22. The fiber winding system according to claim 21, wherein each of the electrical pulses has a pulse width and a rising edge, and wherein the PLC is configured to:

poll the electrical pulses at a first rate selected to identify the electrical pulses to form first data;

poll the first data at a second polling rate selected to rising edges of the electrical pulses in the first data, to form second data; and determine locations of the rising edges of the electrical pulses in the second data to establish the electrical pulse timing.

23. The fiber winding system according to claim 19, wherein the controller further comprises:

an amplifier operably disposed upstream of the A/D converter and configure to amplify the analog electrical signals before they are provided to the A/D converter; and a PLC high-speed input card operably disposed between the A/D converter and the PLC and configured to input the digital electrical signal to the PLC.

24. The fiber winding system according to claim 19, wherein the light source comprises a first fiber bundle and the light detector comprises a second fiber bundle.

25. The fiber winding system according to claim 24, wherein the light source further comprises a light-source optical system configured to form substantially collimated light from a diverging light emitted by the first fiber bundle, and wherein the light detector further comprises a light-detector optical system configured to form from the substantially collimated light substantially focused light directed to an input end of the second fiber bundle.

26. The fiber winding system according to claim 19, wherein the estimated whipping tail timing comprises a timing range, and wherein the electrical pulses falling with the timing range corresponds to the presence of the whipping tail.

* * * * *